US009751342B2

(12) United States Patent
Kurane et al.

(10) Patent No.: US 9,751,342 B2
(45) Date of Patent: Sep. 5, 2017

(54) PRINTING APPARATUS AND PRINTING METHOD

(71) Applicant: SEIKO EPSON CORPORATION, Tokyo (JP)

(72) Inventors: Haruhisa Kurane, Shiojiri (JP); Masayuki Kamijima, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/145,303

(22) Filed: May 3, 2016

(65) Prior Publication Data

US 2016/0325566 A1 Nov. 10, 2016

(30) Foreign Application Priority Data

May 8, 2015 (JP) ..... 2015-095439

(51) Int. Cl.
*B41J 13/00* (2006.01)
*B41J 11/00* (2006.01)

(52) U.S. Cl.
CPC ..... *B41J 13/0009* (2013.01); *B41J 11/0095* (2013.01)

(58) Field of Classification Search
CPC ..... B41J 13/0009
See application file for complete search history.

(56) References Cited

U.S. PATENT DOCUMENTS

2006/0284965 A1* 12/2006 Tsubota ..... B41J 11/425 347/217
2009/0003854 A1 1/2009 Naoi et al.
2009/0315949 A1* 12/2009 Matsumoto ..... B41J 2/155 347/54

FOREIGN PATENT DOCUMENTS

JP 2007-254094 A 10/2007
JP 2007-296647 A 11/2007
JP 2009-255305 A 11/2009
JP 2010-284883 A 12/2010

* cited by examiner

*Primary Examiner* — Jason Uhlenhake
(74) *Attorney, Agent, or Firm* — Workman Nydegger

(57) ABSTRACT

A printing apparatus includes an encoder that detects the rotation of a driving roller that forms a transport device, an imaging device that images a medium during transport by the transport device, and a controller. In a second detecting unit, the imaging device images the medium irradiated with light that the light emission controller causes the light-emitting unit to emit through a strobe control signal. The second detecting unit acquires movement amount of the medium using a plurality of images with different imaging times at which the medium is imaged. In the first detecting unit, a latching circuit holds a rotation amount of a driving roller totaled by a counter at a timing based on the strobe control signal. The controller controls the discharge timing of the print head based on the rotation amount and the movement amount.

11 Claims, 14 Drawing Sheets

PRINTING APPARATUS AND PRINTING METHOD

BACKGROUND

1. Technical Field

The present invention relates to a printing apparatus provided with a transport unit that transports a medium such as a sheet, an imaging unit that images the medium transported by the transport unit, and a print head that prints on the medium, and a printing method.

2. Related Art

In the related art, a printing apparatus provided with a transport unit that transports a medium, such as a sheet, and a print head that prints on the medium transported by the transport unit is widely known as an example of this type of printing apparatus (for example, such as JP-A-2010-284883).

For example, JP-A-2010-284883 discloses a printing apparatus provided with a line-type print head (line head) that discharges ink, a transport unit provided with a rotating roller that transports a medium such as a sheet, a first acquisition unit that acquires rotation information of the rotating roller, and a second acquisition unit that acquires movement information of the medium with a signal processing detecting the surface of the medium during transport. In the printing apparatus, the rotation information of the rotating roller acquired by the first acquisition unit and the movement information of the medium acquired by the second acquisition unit are correlated and stored in memory as correction data for at least one rotation of the rotating roller. The control unit reads out the correction data corresponding to the rotation information of the rotating roller acquired by the first acquisition unit from the memory and performs printing on the medium with the recording timing of the line-type print head corrected. Therefore, even if the transport speed of the medium fluctuates caused by eccentricity of the rotating roller, shifting of the landing position of ink droplets on the medium is suppressed to be low.

In the printing apparatus disclosed in JP-A-2010-284883, the control unit acquires an image of the medium from the imaging unit that forms the second acquisition unit per unit time at a fixed frame rate and acquires rotation information acquired from the detection signal of the encoder that forms the first acquisition unit at a fixed time interval. In this case, even if the time interval at which the rotation information is acquired is the same as the time interval at which the image is acquired, when the time at which the medium is imaged and the time at which the rotation information is acquired are shifted, correction data that includes the shift in the correspondence relationship between the rotation information and the movement information is created. Therefore, even if the discharge timing is corrected based on the movement information acquired from the rotation information with reference to the correction data, the landing position of the ink droplets on the medium shifts in the transport direction of the medium, and this causes the print quality to be lowered.

The same problem arises in a serial printer as in a case of a configuration that performs correction on the transport control based on the rotation information and the movement information. For example, when the transport amount of the medium is corrected based on the shift amount of the correspondence relationship between the rotation information and the movement information during transport of the medium, the correction instead promotes a shift in the next printing position, and promotes a lowering of the print quality due to the shift in printing position. Similarly, in a case of performing error detection based on the rotation information and the movement information, the shift in the correspondence relationship between the rotation information and the movement information becomes a cause of erroneous notification of errors. In this way, in the case of a configuration that performs correction on the control of the printing apparatus based on the rotation information and the movement information, there is concern of the shift of the rotation information and the movement information caused by the shift in the acquisition time of the rotation information and the imaging time of the medium instead leading to defects in the control of the printing apparatus. This type of problem is not limited to a printing apparatus, such as a line printer or a serial printer, and substantially similar problems are present in printing apparatuses in which control is performed based on the rotation information detected by the detecting unit and the movement information based on the image of the medium acquired by the imaging unit.

SUMMARY

An advantage of some aspects of the invention is to provide a printing apparatus and a printing method able to suppress a lowering of control precision caused by shifts in the time at which the detecting unit detects rotation information of the rotating roller and the time at which the imaging unit acquires an image.

Hereinafter, means of the invention and operation effects thereof will be described.

According to an aspect of the invention, there is provided a printing apparatus, including a transport unit that transports a medium by the rotation of a rotating roller, a print head that prints on the medium; an imaging unit that images the medium when transported; a detecting unit that detects rotation information of the transport unit; an acquisition unit that acquires movement information of the medium based on a plurality of images with different imaging times at which the medium is imaged; and a controller that performs control of at least one of the transport unit and the print head based on the rotation information and the movement information, in which the imaging unit includes a light-emitting unit that irradiates the medium with light, and the controller causes the acquisition of the rotation information by the detecting unit and the imaging of the medium by the imaging unit to be synchronized based on the radiation timing at which the medium is intermittently irradiated with light by the light-emitting unit.

According to the configuration, the controller causes the detection of the rotation information by the detecting unit and the imaging of the medium by the imaging unit to be synchronized based on the radiation timing at which the medium is intermittently irradiated with light by the light-emitting unit when the medium is transported. Although the movement speed of the medium fluctuates when the rotating roller rotates eccentrically, since the detection of the rotation information and the imaging of the medium are synchronized and performed at the same timing, a shift amount, which should not be present, arising or a shift amount, which should be present, being eliminated between the rotation information and the movement information is easily avoided because the time at which the rotation information and the imaged image are acquired (rotation angle of the rotating roller) are shifted when the rotating roller rotates eccentrically. Thus, control of at least one of the transport unit and the print head performed based on the rotation information and the movement information can be suitably performed. Error control that outputs the occurrence of an error while an error in the transport system is detected is included in the control of the transport unit, in addition to transport control for transporting the medium.

In printing apparatus according to the aspect, it is preferable that the controller causes the detecting unit to detect the rotation information based on a control signal that provides instructions by which the medium is intermittently irradiated with light by the light-emitting unit to the imaging unit.

According to the configuration, the controller provides instructions to the imaging unit based on the control signal, and the imaging unit images the medium by intermittently irradiating the medium with light from the light-emitting unit. The controller causes the detecting unit to detect the rotation information based on the control signal. Thus, the first time at which the detecting unit detects the rotation information and the second time at which the imaging unit images the medium are synchronized, and the rotation information detected by the detecting unit and the movement information of the medium acquired based on the image are associated. As a result, control with a comparatively high precision can be performed based on the rotation information and the movement information.

In the printing apparatus according to the aspect, it is preferable that the controller corrects the transport amount or transport speed of the transport unit to be controlled based on the rotation information and the movement information.

According to the configuration, the transport amount or the transport speed of the controlled transport unit are corrected by the controller based on the rotation information and the movement information. Thus, since printing with the print head is carried out on the medium at a suitable transport position, a printed matter printed with a high print quality on the medium can be obtained.

In the printing apparatus according to the aspect, it is preferable that the controller controls the print timing of the print head based on the rotation information and the movement information.

According to the configuration, the print timing of the print head is controlled based on the rotation information and the movement information acquired at substantially the same time segment by the controller. Thus, the print timing of the print head can be more suitably controlled.

In the printing apparatus according to the aspect, it is preferable that the correction data that indicates the correspondence relationship between a rotation angle of the rotating roller and the movement amount of the medium is stored in a storage unit, the detecting unit detects the rotation amount and the rotation angle of the rotating roller, and acquires, as rotation information, estimated movement information that is movement information estimated for the medium based on the rotation amount and the rotation angle with reference to the correction data, and the controller corrects the print timing of the print head based on the estimated movement information and the movement information.

According to the configuration, the controller acquires the estimated movement information of the medium from the rotation amount detected by the rotation amount detecting unit with reference to the correction data, and the print timing of the print head is controlled based on the estimated movement information and the movement information. Thus, even in a case where the rotating roller rotates eccentrically, the printing on the medium can be performed at a more suitable print timing by the print head.

It is preferable that the printing apparatus according to the aspect further includes a second acquisition unit that acquires an estimated movement speed of the medium according to the rotation angle of the rotating roller, and the controller corrects the print timing based on estimated movement speed, the rotation information, and the movement information, and a first period at which the print timing is corrected based on the estimated movement speed is shorter than a second period at which the print timing is corrected based on the rotation information and the movement information.

According to the configuration, the estimated movement speed of the medium is acquired by the second acquisition unit according to the rotation angle of the rotating roller. The controller corrects the print timing based on the estimated movement speed, the rotation information, and the movement information. At this time, the first period in which the print timing is corrected based on the estimated movement speed is shorter than the second period in which the print timing is corrected based on the rotation information and the movement information. Thus, for the reason of ensuring the required time necessary for imaging of the medium by the imaging unit, even if the second period in which the print timing is corrected based on the rotation information and the movement information is unable to be relatively shortened in proportion to the rotation period of the rotating roller, since the first period in which print timing is corrected based on the estimated movement speed is short, correction can be performed at a suitable print timing.

In the printing apparatus according to the aspect, it is preferable that the rotation information includes the rotation angle and the rotation speed of the rotating roller, the movement information is the movement speed of the medium, and the controller estimates the rotation information and the movement information during the printing time performed after the time at which the medium is imaged, based on the rotation angle and the rotation speed, and corrects the print timing during the printing time based on the estimated rotation information and the movement information.

According to the configuration, the controller estimates the rotation information and the movement information during the printing time performed later than the time at which the medium is imaged based on the rotation angle and the rotation speed of the rotating roller, and corrects the print timing during the printing time based on the estimated rotation information and the movement information. Thus, since the print timing during the printing time performed later than the imaging time of the medium is corrected, printing can be performed on the medium at a high print position precision.

In the printing apparatus according to the aspect, it is preferable that the rotation information is an estimated movement speed of the medium estimated based on the rotation speed of the rotating roller, the movement information is the movement speed of the medium, and the controller, when a difference between the estimated movement speed and the movement speed exceeds a threshold, outputs that a defect in the transport system occurs to an output unit.

According to the configuration, when the difference between the estimated movement speed of the medium detected by the detecting unit and the movement speed of the medium acquired by the acquisition unit exceeds a threshold, the controller outputs that a defect occurs in the transport system to the output unit. Thus, the user can be informed that a defect in the transport system occurs from the output content of the output unit.

It is preferable that the printing apparatus according to the aspect further includes an imaging controller that controls the imaging unit, in which the detecting unit includes an encoder that either directly or indirectly detects the rotation of the rotating roller, a rotation amount detecting unit that detects a rotation amount of the rotating roller based on a detection signal of the encoder, and a latching unit that holds a detection value of the rotation amount detecting unit and acquires the rotation information based on the rotation amount held by the latching unit, and the imaging controller, based on a control signal formed from a pulse signal, finishes irradiation of the medium with light by the light-emitting unit started during rising of the pulse during falling of the pulse, and causes the latching unit to hold a detection value of the rotation amount detecting unit during falling of the pulse of the control signal.

According to the configuration, the imaging controller finishes irradiation of the medium with light by the light-emitting unit started during rising of the pulse of the control signal during falling of the pulse. The medium is imaged by the imaging unit when irradiated with light. The latching unit holds the rotation amount that is the detection value of the rotation amount detecting unit during falling of the pulse of the control signal. Thus, the time at which the rotation amount is detected and the time at which the medium is imaged can be more precisely synchronized, and correction of the control content can be more suitably performed based on the rotation information and the movement information.

According to another aspect of the invention, there is provided a printing method including: transporting a medium through rotation of a rotating roller of a transport unit; imaging the medium with an imaging unit when irradiated with light by a light-emitting unit that intermittently emits light when the medium is transported; detecting rotation information of the rotating roller; acquiring movement information of the medium based on a plurality of images with different imaging times at which the medium is imaged; and controlling at least one of a print head that prints on the medium and the transport unit based on the rotation information and the movement information, in which, in the controlling, detection of the rotation information and imaging of the medium are synchronized based on the radiation timing at which the medium is intermittently irradiated with light by the light-emitting unit. According to the configuration, the same actions and effects as the above-described printing apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Below, a first embodiment in which the printing apparatus is realized as a line printer will be described with reference to the drawings. The printing apparatus of the embodiment is an ink jet-type printer (liquid discharging apparatus) that performs printing by discharging ink that is an example of a liquid on a medium.

Figure 1:
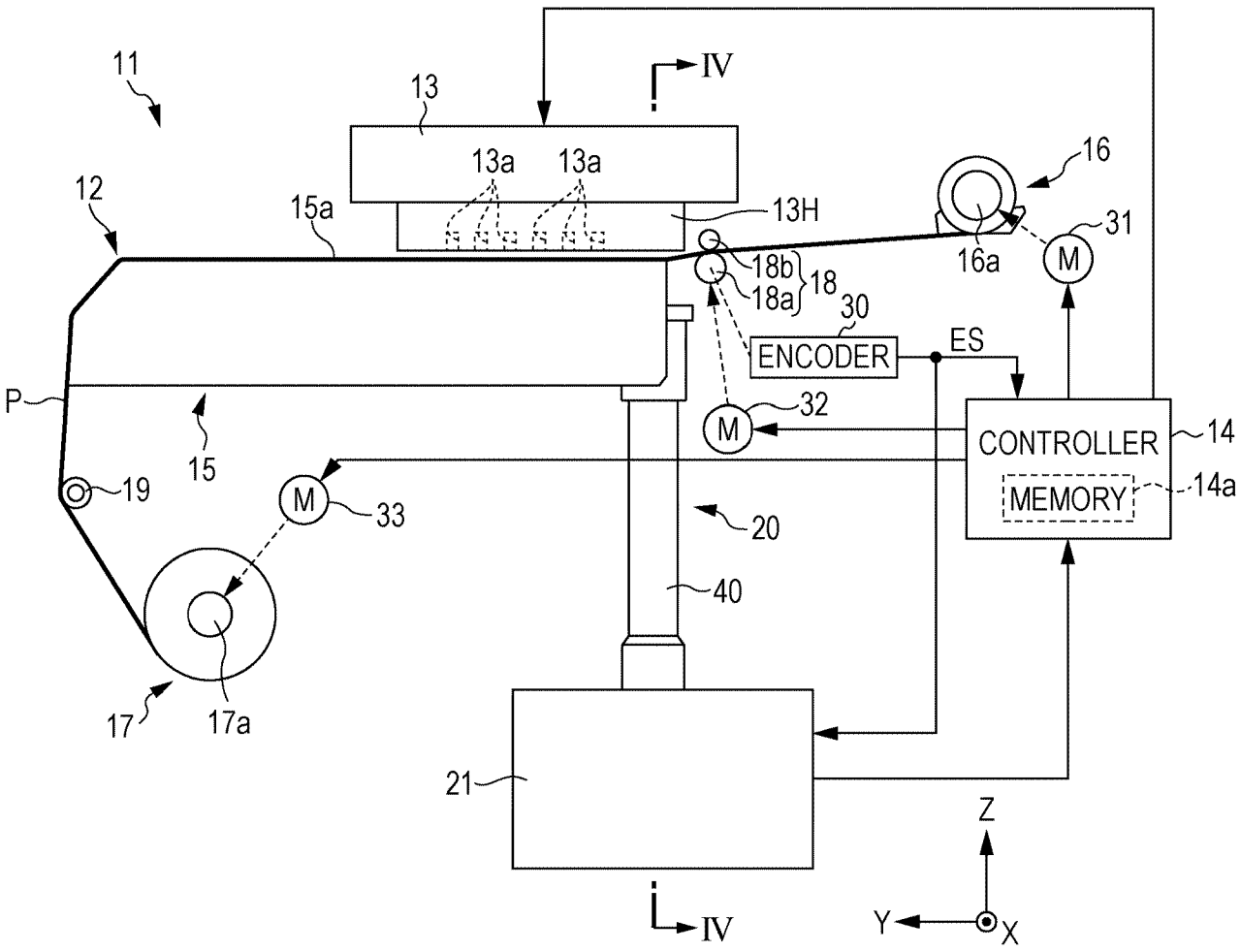
FIG. 1 is a schematic configuration diagram of a line-type printing apparatus in a first embodiment.
Figure 2:
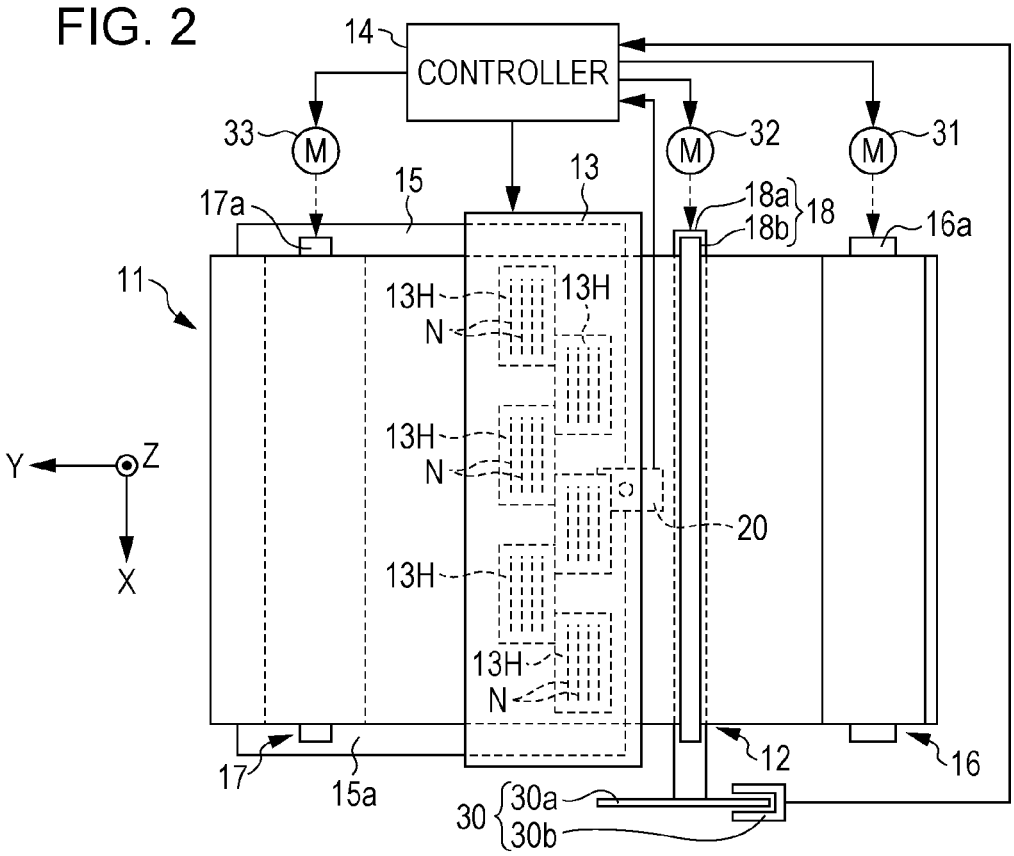
FIG. 2 is a schematic plan diagram illustrating the printing apparatus.

As illustrated in FIGS. 1 and 2, the printing apparatus 11 is provided with a transport device 12 as an example of a transport unit that transports a medium P formed from a long sheet-like continuous paper, a printing unit 13 that performs printing by discharging ink on a medium P transported by the transport device 12, and a controller 14 as an example of a controller that controls the transport device 12 and the printing unit 13.

In the printing apparatus 11, a medium support unit 15 having a support surface 15*a* that supports the medium P transported by the transport device 12 is arranged at a position facing the printing unit 13 with the transport path of the medium P interposed.

The transport device 12 is provided with a delivery unit 16 that deliveries the medium P, and a winding unit 17 that winds up the medium P on which printing is performed by the printing unit 13. The transport device 12 includes a transport roller pair 18 arranged at position between the delivery unit 16 and the medium support unit 15 on the transport path and a tension roller 19 arranged at a position between the medium support unit 15 and winding unit 17 on the transport path. The transport device 12 of the example uses a roller transport method.

The delivery unit 16 includes a delivery shaft 16*a* driven to rotate, and a roll on which the medium P is wound in a roll-shape in advance is supported on the delivery shaft 16*a* to be able to rotate integrally with the delivery shaft 16*a*. The medium P is delivered from the roll toward the transport roller pair 18 by the delivery shaft 16*a* being driven to rotate.

The transport roller pair 18 includes a rotationally driven driving roller 18*a* and a driven roller 18*b* driven by the rotation of the driving roller 18*a*. The transport roller pair 18 guides the medium P to the support surface 15*a* by rotating in a state where the medium P is interposed (nipped) between the driving roller 18*a* and the driven roller 18*b*. The tension roller 19 imparts a predetermined tension to a printed region on the medium P.

The winding unit 17 includes a rotationally driven winding shaft 17*a*. The printed medium P transported from the tension roller 19 side is sequentially wound by the winding shaft 17*a* by the winding shaft 17*a* being driven to rotate.

The transport device 12 is further provided with a feed motor 31 that is the power source by which the delivery shaft 16*a* is rotated, a transport motor 32 that is the power source by which the driving roller 18*a* is rotated, and a winding motor 33 that is the power source by which the winding shaft 17*a* is rotated. The controller 14 controls the driving speed of the transport motor 32, and controls the respective driving speeds of the feed motor 31 and the winding motor 33 matched to the transport speed of the medium P transported by the transport roller pair 18. In so doing, the medium P is delivered while imparting a suitable amount of slack, and the medium P printed by the printing unit 13 during transport is wound up while a suitable tension is imparted.

The printing unit 13 illustrated in FIGS. 1 and 2 is a line head-type having a predetermined length in the width direction X (direction orthogonal to the paper surface of the FIG. 1) so that printing is possible over the entire width region of the medium P with the assumed maximum width. The printing unit 13 of the example is a so-called multi-head type in which a plurality of print heads 13H is arranged in a predetermined arrangement pattern along the length direction. The plurality of print heads 13H are arranged in a zig-zag form by shifting two rows of print heads 13H arranged with a fixed gap (pitch) by a half pitch in the row direction between rows. The print heads 13H are provided with a plurality of nozzle rows N (in the example in FIG. 2, four rows) in which a plurality of nozzles 13*a* able to discharge each color of ink are arranged in one row in the width direction X. In the example in FIG. 2, the plurality of nozzle rows N discharge four colors of ink droplet, black (K), cyan (C), magenta (M), and yellow (Y) from the respective nozzles 13*a*. The plurality of nozzle rows N able to discharge the same color of ink are continuously distributed in the width direction X. Therefore, in the printing apparatus 11, printing on the full width can be performed on the medium P with an assumed maximum width by each print head 13H.

The controller 14 illustrated in FIGS. 1 and 2 controls the discharge of ink droplets from the nozzles of the print head 13H by outputting discharge data generated based on the input print job data PD to the printing unit 13. Images, text or the like are printed on the medium P based on the print job data PD by the ink droplets discharged by each print head 13H from the nozzles of the nozzle row N landing on the surface of the medium P during transport. For the print head 13H of the example, the discharge driving method is a piezoelectric method using a piezoelectric element or a static-type using a static electric element. The driving method of the print head 13H may also be a thermal method in which ink droplets are discharged using the expansion pressure of air bubbles generated by film boiling of ink heated by a discharge driving element formed from a heater element. The printing unit 13 may have a configuration having a single long-form print head instead of the multi-head type.

As illustrated in FIG. 1, the imaging device 20 that is an example of the imaging unit that detects in a non-contact manner the movement amount (transport amount) of the medium P based on the image in which the medium P is imaged is attached to the printing apparatus 11. The imaging device 20 images a portion of the region that is a position further to the downstream side in the transport direction Y than the transport roller pair 18 and a position further to the upstream side in the transport direction Y than the printing region on which printing is performed on the medium P by the printing unit 13. An encoder 30 formed from a rotary encoder and that detects the rotation of the driving roller 18*a* is provided in the printing apparatus 11. The reason for setting the imaging area of the imaging device 20 to the above-described position is in order to make the region before printing to the imaging area so that it is possible to detect the movement amount of the medium P as close to the printing region on the medium P as possible, and there is no concern of mis-detection caused by ink passing through the rear surface when the medium P is thin. The imaging area may be a position further to the upstream side in the transport direction Y than the transport roller pair 18 or may be rear surface of the printing region as long as the medium P uses is sufficiently thick. The imaging area may be the surface (printing surface) on which printing is carried out on the medium P. However, in a case of the surface of the medium P, it is preferable that the position is further to the upstream side in the transport direction Y than the printing region.

Figure 3:
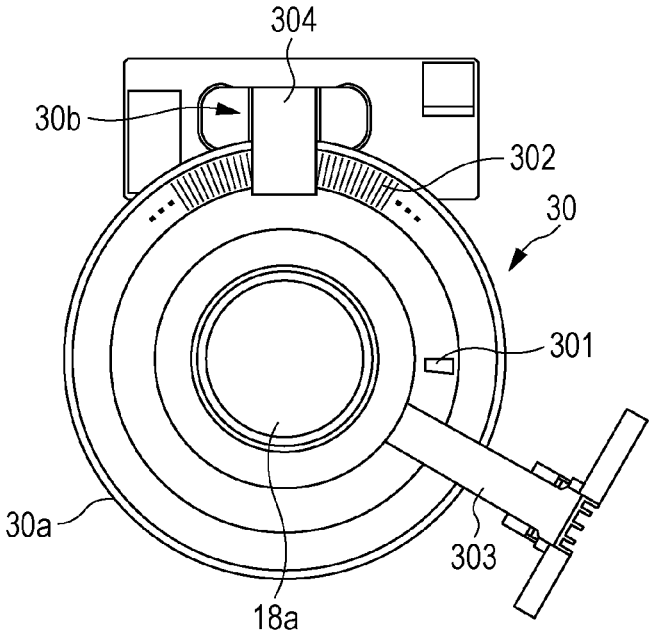
FIG. 3 is a schematic side diagram illustrating a rotary encoder.

As illustrated in FIGS. 2 and 3, the encoder 30 includes a disk-shaped scale plate 30*a* fixed to one end portion of the driving roller 18*a* to be able to rotate integrally and an optical-type sensor 30*b* that optically detects numerous detected portions formed with a fixed pitch in the peripheral direction on the peripheral edge portion of the scale plate 30*a*. The encoder 30 outputs an encoder pulse signal ES (below, also referred to as "encoder signal ES") that includes a plurality of pulses proportional to the rotation amount of the driving roller 18*a*.

As illustrated in FIG. 3, on the scale plate 30*a* of the encoder 30, the first detected portion 301 for detecting the origin is formed at one position in the circumferential direction of the part toward the inner periphery and a plurality of second detected portions 302 are formed along the total circumference at a fixed pitch in the circumferential direction at a part toward the outer circumference. A predetermined number, in a range of 100 to 1000, of second detected portions 302 is provided on one round of the scale plate 30*a*.

As illustrated in FIG. 3, the optical-type sensor 30*b* is provided with a first sensor 303 that detects the first detected portion 301 and a second sensor 304 that detects the second detected portions 302. Each sensor 303 and 304 is formed from a photointerrupter. The first sensor 303 outputs an origin signal that includes an origin pulse while detecting the first detected portion 301 each time the scale plate 30*a* that rotates with the driving roller 18*a* is arranged as the origin position. The second sensor 304 generates a pulse each time the second detected portion 302 with a fixed pitch is detected in the process in which the scale plate 30*a* rotates with the driving roller 18*a*, and outputs the encoder signal ES that includes a number of pulses that is proportional to the rotation amount of the driving roller 18*a*. The encoder signal ES output from the encoder 30 is input to the controller 14.

The controller 14 generates the discharge timing signal PTS that stipulates the discharge timing of the print head 13H based on the encoder signal ES, and controls the discharge timing at which the ink droplets are discharged from the nozzles 13*a* of the print head 13H based on the discharge timing signal PTS. In the print head 13H, the ink droplets are discharged at a discharge timing based on the discharge timing signal PTS from the nozzle 13*a* that is to discharge based on the discharge data. In the example that is an ink jet-type printing apparatus 11, the discharge timing at which the ink droplets are discharged from the print head 13H corresponds to an example of the print timing.

The imaging device 20 images the texture (paper surface shape) of the rear surface that is the non-printing surface of the medium P transported by the transport device 12 per unit time, and outputs the image signal to the detection controller 21 arranged on the lower portion of the imaging device 20. The imaging device 20 images the medium P with a predetermined sampling period, for example, within a range of 10 to 1000 Hz. The detection controller 21 acquires the movement amount Δy per unit time of the medium P by performing a template matching process based on two continuous images (image data) of the present and previous times, and outputs the result to the controller 14 each time an image (still image) is obtained based on the image signal from the imaging device 20. Here, the movement amount Δy per unit time of the medium P is the same as the medium movement speed Vp.

The detection controller 21 detects the rotation amount Δr per unit time of the driving roller 18*a* based on the encoder signal ES input from the encoder 30, and outputs the results to the controller 14. Here, the rotation amount Δr per unit time corresponds to the movement amount in the circumferential direction per unit time in which the eccentric rotation of the driving roller 18*a* is taken into consideration at the nip point (interposing point) where the medium P is interposed between the driving roller 18*a* and the driven roller 18*b*, and is the same as the peripheral speed at the nip point of the driving roller 18*a*. The rotation amount Δr corresponds to the estimated movement amount per unit time of the medium estimated taking the influence of the eccentric rotation according to the rotation angle θ of the driving roller 18*a* at that time from the rotation amount δr of the driving roller 18*a*, that is, the medium estimated movement speed Vr, into consideration. In the embodiment, the rotation amount Δr per unit time in which the eccentric rotation of the driving roller 18*a* is taken into account, that is, the medium estimated movement speed Vr, corresponds to an example of the rotation information. The medium movement speed Vp that is the movement amount Δy per unit time of the medium P corresponds to an example of the movement information of the medium.

Figure 4:
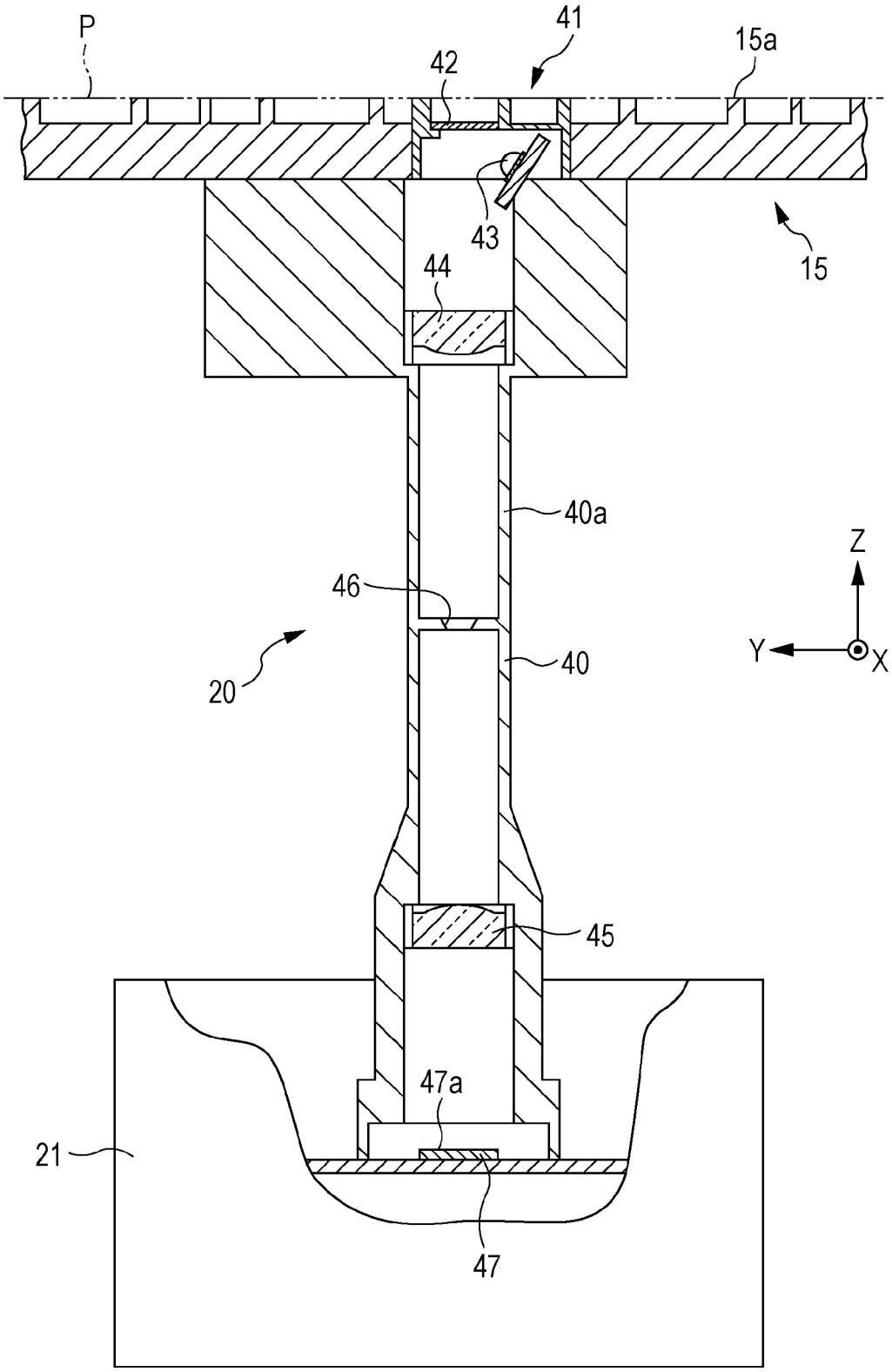
FIG. 4 is a cross-sectional diagram taken along the line IV-IV in FIG. 1.

Next, the detailed configuration of the imaging device 20 will be described with reference to FIG. 4. As illustrated in FIG. 4, the imaging device 20 is provided with a cylindrical lens body 40 extended in the direction Z orthogonal to the support surface 15*a*. The lens body 40 is fixed to the medium support unit 15 by a screw (not shown) in the upper end portion thereof, and is fixed to the housing of the detection controller 21 by a screw (not shown) in the lower end portion thereof.

A lens body cover 41 is attached to the upper end portion of the lens body 40 so as to block the lens body 40 from the upper side. A colorless transparent light transmitting member 42 that allows the transmission of light is fixed to the lens body cover 41. A light-emitting unit 43 that irradiates the non-printing surface (lower surface) of the medium P with light is arranged in the space formed by the upper end portion of the lens body 40 and the lens body cover 41. The light-emitting unit 43 is a light source such as a light-emitting diode (LED) or a halogen lamp, and is formed from a light-emitting diode in the example. The light-emitting unit 43 radiates light across the light transmitting member 42 from the rear surface side of the medium P transported on the support surface 15*a* toward the medium P.

An object lens 44 (collecting lens) that is an example of an optical member is accommodated on the upper end side in the direction Z of the body 40*a* of the lens body 40, and a projection lens 45 that is an example of an optical member is accommodated on the lower end side of the body 40*a*. The diaphragm 46 positioned between the object lens 44 and the projection lens 45 is formed in the body 40*a* of the lens body 40.

The object lens 44 is a telecentric lens as an example, and causes reflection light that again passes through the light transmitting member 42 after the light is emitted from the light-emitting unit 43 and passes through the light transmitting member 42 and is incident on the medium P and is incident in the body 40*a* of the lens body 40 to be collected. The concentrated reflection light is restricted by the diaphragm 46. The projection lens 45 is a telecentric lens as an example, and causes light passing through the diaphragm 46 to be collected.

An imaging element 47 having an imaging surface 47*a* on which an image of the medium P on which light is collected by the projection lens 45 is formed is arranged on the lower end portion of the lens body 40 accommodated in the detection controller 21. The imaging element 47 is formed, for example, by a two-dimensional image sensor. The two-dimensional image sensor is formed by a CCD image sensor or a CMOS image sensor. The imaging element 47 is accommodated in a darkroom in the lens body 40 and images the image of the medium P when the light-emitting unit 43 intermittently performs strobe light emission. The image signal obtained with the imaging device 20 imaging the rear surface of the medium P is output to the detection controller 21.

Figure 5:
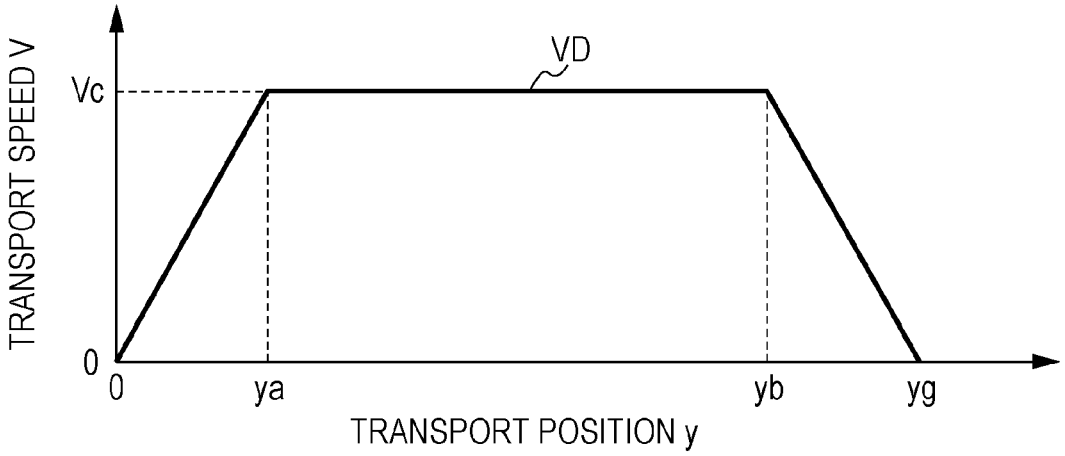
FIG. 5 is a graph illustrating speed control data used in transport control.

Next, the speed control of the transport motor 32 by the controller 14 will be described with reference to FIG. 5. The speed control data VD illustrated by the graph in FIG. 5 is stored in the memory 14*a* formed from a nonvolatile memory, provided in the controller 14 as an example of a storage unit. The speed control data VD is data in which the relationship between the transport position y and the transport speed V is represented. The transport position y is a value in which the motor rotation amount from the origin is converted to a count value that manages the transport position of the medium P with the driving start position of the transport motor 32 as the origin. The range from the origin that is the transport position y to the transport position ya is the acceleration range, and when the target transport speed Vc (fixed speed) is reached at the transport position ya, the target transport speed Vc is maintained. Printing on the medium P by the printing unit 13 is performed when the medium P is transported at a constant target transport speed Vc. By the medium P being transported to a stipulated position with printing finished, when the transport position y reaches the deceleration start position yb, deceleration of the transport motor 32 is started, and driving of the transport motor 32 is stopped at the stop position yg. The controller 14 acquires the target speed corresponding to the transport position y with reference to the speed control data VD from the transport position y in which the encoder signals ES are totaled from the driving start time of the transport motor 32 and feedback control is performed so that the actual speed approaches the target speed. In place of the feedback control, a feed forward control may be performed.

There are cases where the driving roller 18*a* is incorporated eccentrically to a rotating shaft or a bearing that transmits power from the transport motor 32 to the driving roller 18*a*. In this case, when the transport motor 32 is driven at a constant speed during printing, the driving roller 18*a* rotates eccentrically.

Figure 6A:
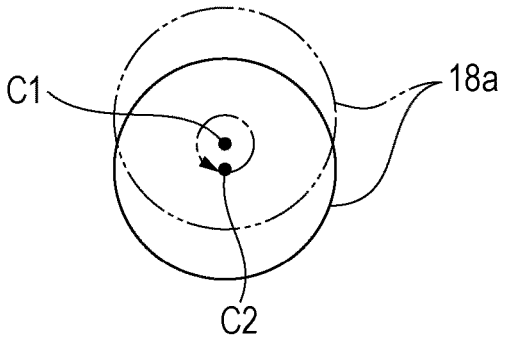
FIG. 6A is a schematic side diagram illustrating a condition of eccentric rotation of a driving roller.

As illustrated in FIG. 6A, when the driving roller 18*a* is incorporated in a state where the axial center C2 (axial line) is eccentric with respect to the center of rotation C1 (rotating shaft line) of the rotating shaft, the axial center C2 of the driving roller 18*a* rotates the circumference of the center of rotation C1 so as to describe a circle. As a result, the driving roller 18*a* rotates eccentrically.

Figure 6B:
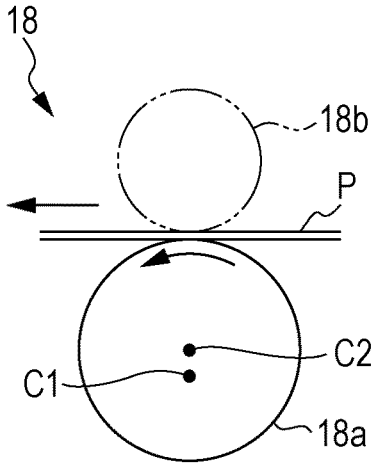
FIGS. 6B and 6C are schematic side diagrams illustrating a condition in which the medium is transported by the driving roller that rotates eccentrically.

As illustrated in FIG. 6B, when the axial center C2 of the driving roller 18*a* is positioned further to the medium P side (upper side in the drawing) than the center of rotation C1, the distance (rotation radius) between the center of rotation C1 and the medium P becomes comparatively long, and the transport speed of the medium P fluctuates to the higher speed side. Meanwhile, as illustrated in FIG. 6C, when the axial center C2 of the driving roller 18*a* is positioned further to side opposite the medium P (lower side in the drawing) than the center of rotation C1, the distance (rotation radius) between the center of rotation C1 and the medium P becomes comparatively short, and the transport speed of the medium P fluctuates to the lower speed side.

Figure 6C:
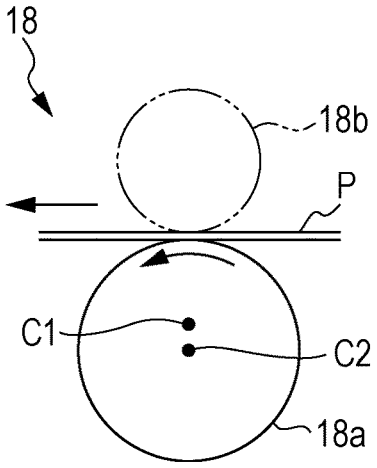

Therefore, even if the rotation speed of the driving roller 18*a* is constant and the pulse period of the encoder signals ES output from the encoder 30 is constant, in a case where the driving roller 18*a* rotates eccentrically as illustrated in FIGS. 6A to 6C, the transport speed of the medium P periodically fluctuates at the period of one rotation of the driving roller 18*a*. That is, the movement amount by which the medium P moves in a unit time with respect to the rotation angle per unit time of the driving roller 18*a* fluctuates while the driving roller 18*a* rotates once.

The pulse period of the discharge timing signal PTS is proportional to the pulse period of the encoder signal ES. Therefore, even if ink droplets are discharged at a fixed discharge period from the printing unit 13 based on the discharge timing signal PTS with the driving roller 18*a* rotating at a constant speed during printing, when the movement speed of the medium P periodically fluctuates due to the eccentric rotation of the driving roller 18*a*, the dot pitch in the transport direction Y of the print dots printed on the medium P fluctuates. Therefore, in the embodiment, the correction data indicating the correspondence relationship between the rotation angle θ of the driving roller 18*a* and the movement amount per unit time of the medium P is stored in the memory, not shown, in the detection controller 21 taking the eccentric rotation of this type of the driving roller 18*a* into consideration.

The correction data is formed as outlined next. The controller 14 transports the medium P while the driving roller 18*a* is rotated at a lower fixed speed than during printing, and, when the origin signal is input from the encoder 30, printing of a test pattern is started. An origin mark is printed in the test pattern each time the origin signal is input. Printing of the test continues while the driving roller 18*a* performs N rotations (here, N is a natural number). The speed fluctuations of the medium P due to the eccentric rotation of the driving roller 18*a* appear as fluctuations in the dot pitch of the printing dots of the test pattern. The test pattern is read by a scanner device, not shown, and the dot pitch of the printing dots in the transport direction Y from the origin mark (rotation angle θ=0 degrees) is measured. Here, the dot pitch corresponds to the unit movement amount of the medium P when there is no slipping between the medium P and the driving roller 18*a*. The controller 14 creates the correction data indicating the correspondence relationship between the rotation angle θ and the correction value from the correspondence relationship between the rotation angle θ and the dot pitch, that is, the correspondence relationship between the rotation angle θ and the unit movement amount (example of the movement amount) of the medium P. The correction value is a correction correspondence in which the rotation amount δr per unit time that does not take the eccentric rotation of the driving roller 18*a* into consideration is converted to the rotation amount Δr per unit time in which the eccentric rotation is taken into consideration. The sampling rate per one rotation of the driving roller 18*a* during creation of the correction data is a predetermined value, for example, within a range of 10 to 100.

The controller 14 acquires the rotation amount Δr (medium estimated movement speed Vr) per unit time of the driving roller 18*a* and the movement amount Δy (medium movement speed Vp) per unit time of the medium P from the detection controller 21. The controller 14 performs correction of the transport speed of the medium P and correction of the discharge timing of the print head 13H based on the medium estimated movement speed Vr and the medium movement speed Vp. In the former correction, the controller 14 corrects the target transport speed Vc of the transport motor 32 based on the medium estimated movement speed Vr (=Δr) and the medium movement speed Vp (=Δy). In the latter correction, the controller 14 corrects the discharge timing according to the shift amount when there is a shift amount in which the acceptable range between the medium estimated movement speed Vr (=Δr) estimated with the eccentric rotation of the driving roller 18*a* taken into consideration and the medium movement speed Vp (=Δy).

Figure 7A:
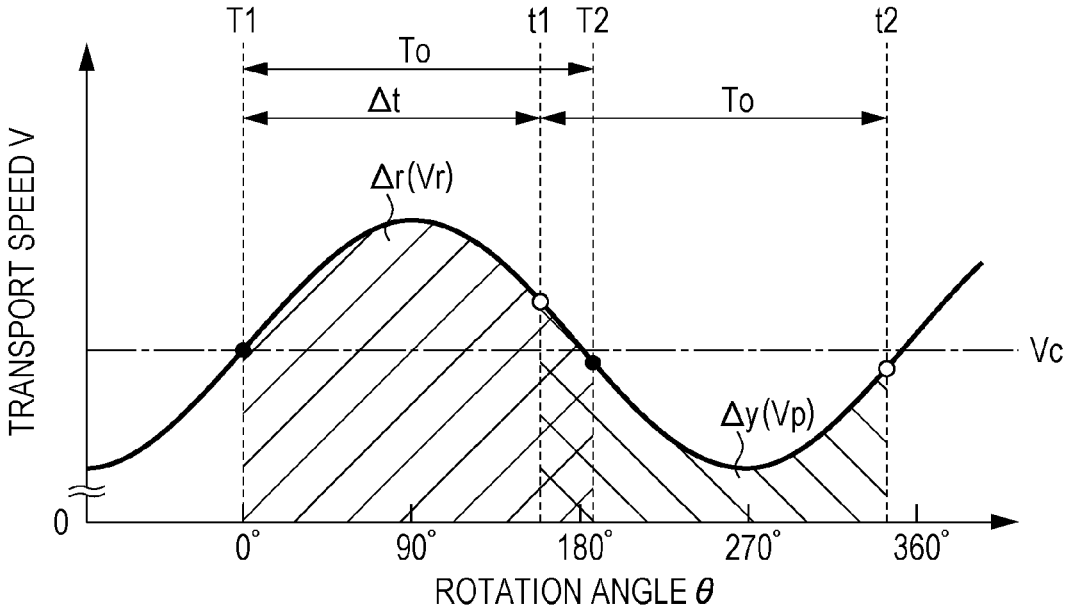
FIG. 7A is a graph illustrating a case in which the detection time of the rotation amount of the driving roller and the imaging time of the medium are shifted.

Next, a defect in the control generated in a case where the time at which the rotation amount Δr of the driving roller 18*a* is acquired and the time at which the medium P is imaged are shifted will be described with reference to FIG. 7A. The peripheral speed at the nip point of the driving roller 18*a* when rotating eccentrically periodically fluctuates according to the rotation angle of the driving roller 18*a* as illustrated in FIG. 7A. When the acquisition times T1 and T2 of the rotation amount Δr and the imaging times t1 and t2 of the medium P are shifted, even if the unit times To at which sampling is performed are the same, a shift arises in the rotation amount Δr and the movement amount Δy caused by the eccentric rotation of the driving roller 18*a*.

That is, in FIG. 7A, a large shift amount is generated between the rotation amount Δr indicated by the area of an oblique region falling to the left detected during times T1 and T2 and the movement amount Δy indicated by the area of an oblique region falling to the right in the drawing acquired by a template matching process based on the two images F1 and F2 obtained by imaging the medium P in each of the times t1 and t2. When the discharge timing is corrected regarding this shift amount as slipping of the medium P or the like, variations in the dot pitch in the transport direction Y of the print dots are instead promoted.

Figure 7B:
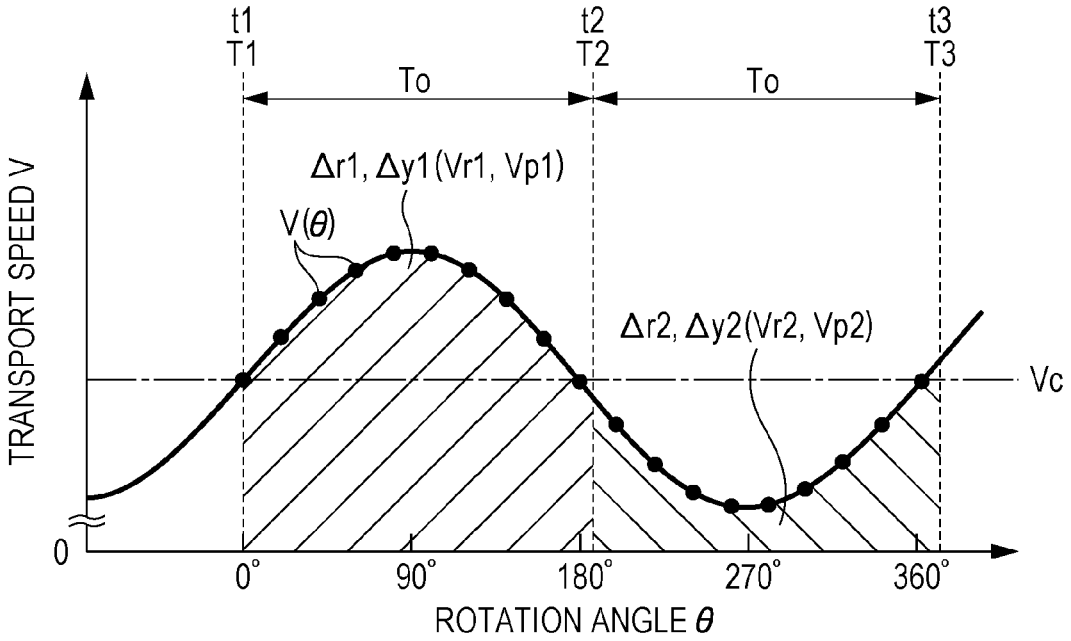
FIG. 7B is a graph illustrating a case in which the synchronization is performed so that the detection time of the rotation amount of the driving roller and the imaging time of the medium match.

Here, in the embodiment, as illustrated in FIG. 7B, synchronization of the first time and the second time is achieved based on the strobe control signal St that stipulates the radiation timing at which the medium P is irradiated with light with the light-emitting unit 43 caused to intermittently emit light so that the times T1, T2, and T3 (first time) at which the rotation amount Δr is acquired and the times t1, t2, and t3 (second time) at which the medium P is imaged are matched. Therefore, the rotation amount Δr1 indicated by the area of the oblique region falling to the left acquired during times t1 and t2 and the movement amount Δy1 indicated by the area of the oblique region falling to the left acquired during the times T1 and T2 become the same. Similarly, the rotation amount Δr2 acquired during the times t2 and t3 and the movement amount Δy2 acquired during the times T2 to T3 are together indicated by the area of the oblique area falling to the right in the drawing, and become the same. In the embodiment, the strobe control signal St corresponds to an example of the control signal.

Figure 8:
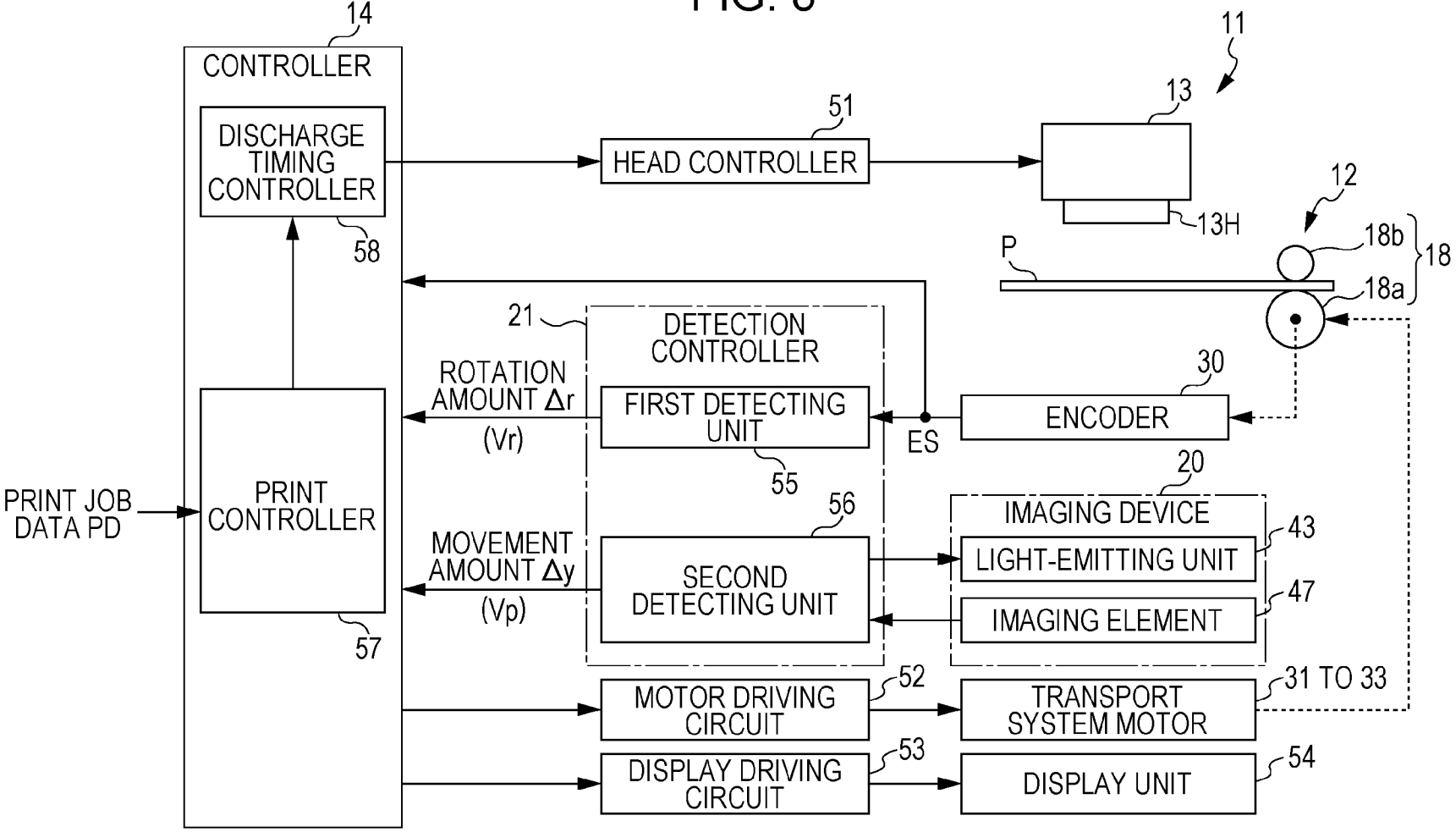
FIG. 8 is a block diagram illustrating the electrical configuration of the printing apparatus.

FIG. 8 illustrates the electrical configuration of the printing apparatus 11. The printing apparatus 11 is provided with a head controller 51, a motor driving circuit 52, a display driving circuit 53, and a display unit 54, in addition to the controller 14, the transport device 12, the printing unit 13, the imaging device 20, the detection controller 21, an encoder 30, and transport system motors 31 to 33. The detection controller 21 is provided with a first detecting unit 55 as an example of the detecting unit that detects the rotation amount Δr of the driving roller 18*a* based on the encoder signal ES input from the encoder 30 and a second detecting unit 56 as an example of the acquisition unit that detects the movement amount Δy of the medium P based on a portion of the image of the medium P imaged by the imaging element 47 that forms the imaging device 20. The rotation amount Δr detected by the first detecting unit 55 and the movement amount Δy detected by the second detecting unit 56 are input together to the controller 14.

The controller 14 ascertains the print mode, the medium type and the medium size based on the print job data PD input from a host device (not shown). The controller 14 causes the medium P to be transported according to a predetermined speed profile by controlling the driving of the transport system motors 31 to 33 via a motor driving circuit 52 based on the speed control data VD read out from the memory 14*a* according to the print mode. The controller 14 performs discharge control that causes each print head 13H to discharge ink droplets according to the discharge data by sending each discharge data item in which the printing image data in the print job data PD is distributed via the head controller 51 to each print head 13H. In so doing, an image or the like is printed on the medium P based on the printing data by the printing unit 13.

The controller 14 is provided with a computer having a central processing unit (CPU), an application specific integrated circuit (ASIC) as a custom LSI, a ROM, a RAM, a nonvolatile memory (for example, a flash ROM), and the like. The controller 14 is provided with a print controller 57 constructed by at least one of a CPU and an ASIC, and a discharge timing controller 58. The print controller 57 performs control of the discharge timing of the print head 13H and speed control of the transport system motors 31 to 33 based on the rotation amount Δr input from the first detecting unit 55 and the movement amount Δy input from the second detecting unit 56. The discharge timing controller 58 corrects the discharge timing of the print head 13H based on the rotation amount Δr (=Vr) and the movement amount Δy (=Vp) according to instructions from the print controller 57.

Figure 9:
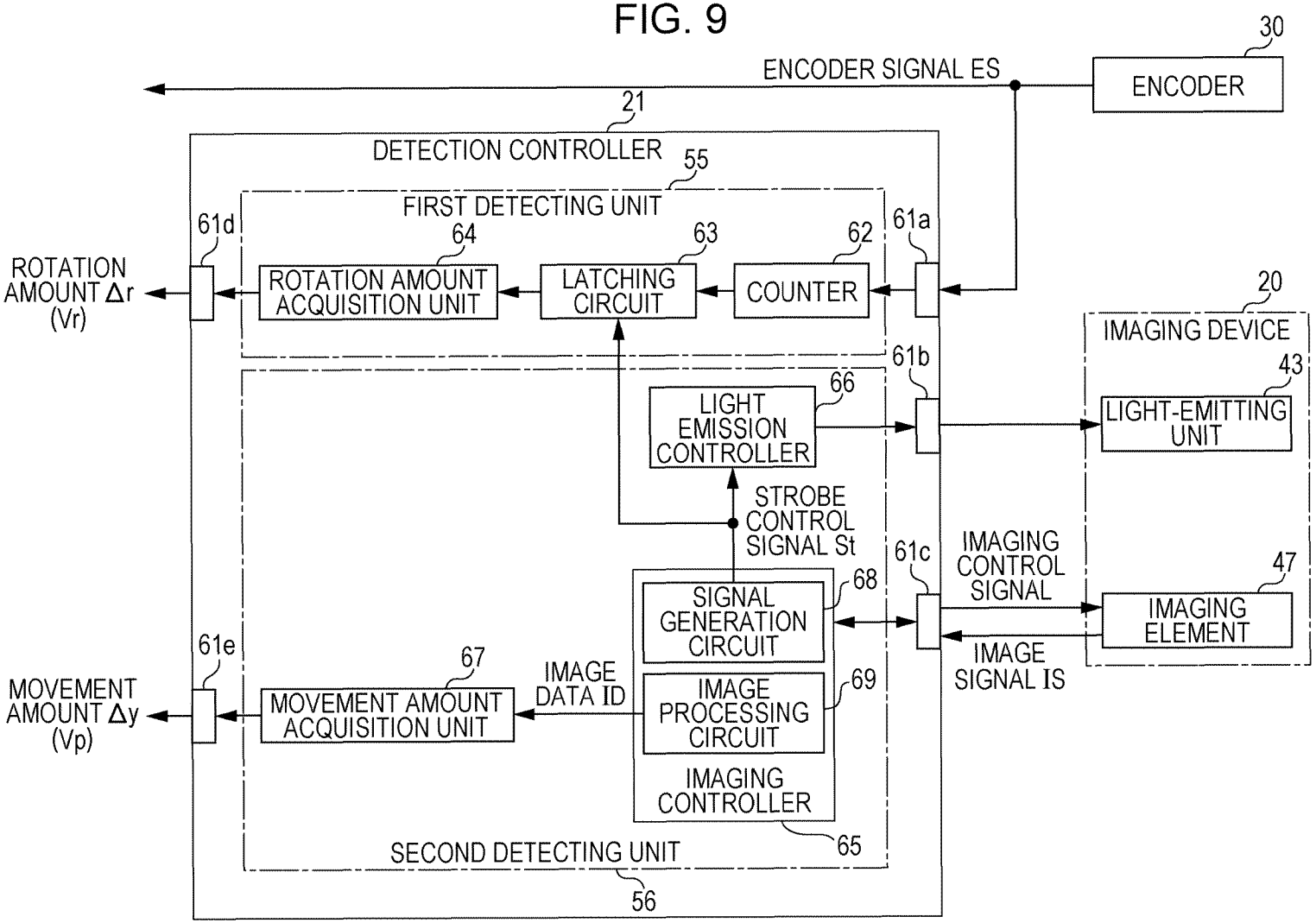
FIG. 9 is a block diagram illustrating an electrical configuration of an imaging device and a detection controller.

Next, the detailed configuration of the detection controller 21 will be described with reference to FIG. 9. As illustrated in FIG. 9, the first detecting unit 55 is provided with a counter 62 that totals the number of pulse edges of the encoder signal ES input from the encoder 30 via an input port 61*a* and a latching circuit 63 that holds the total value of the counter 62 at the imaging timing. The counter 62 acquires the rotation amount r of the driving roller 18*a* as a total value by being reset before the driving start of the transport system motors 31 to 33, and totaling the number of edges of the encoder signal ES input subsequent to the reset.

The latching circuit 63 holds the current rotation amount r during input from the counter 62 each time the radiation timing at which the medium is irradiated with light is reached in order to perform imaging for each fixed period (unit time To). The rotation amount acquisition unit 64 stores the previous rotation amount r1 in the storage unit, acquires the rotation amount δr per unit time by calculating the difference between previous rotation amount r1 and the current rotation amount r2 each time the current rotation amount r2 is input, and acquires the rotation amount Δr per unit time To in which the eccentric rotation of the driving roller 18*a* is taken into consideration based on the rotation amount δr. Specifically, the rotation amount acquisition unit 64 has a storage unit, not shown, that stores the correction data and a counter for the rotation angle total, not shown, that is reset each time the origin signal is input from the encoder 30 built-in. The counter totals the number of pulse edges of the encoder signal ES and acquires the total value as the rotation angle θ. The rotation amount acquisition unit 64 acquires the correction value corresponding to the rotation angle θ with reference to the correction data based on the rotation angle θ read out from the counter and acquires the rotation amount Δr (=Vr) per unit time by multiplying the correction value by the rotation amount Δr. The first detecting unit 55 outputs the detected rotation amount δr to the controller 14 via an output port 61*d*.

As illustrated in FIG. 9, the second detecting unit 56 is provided with an imaging controller 65, a light emission controller 66, and a movement amount acquisition unit 67. The imaging controller 65 is provided with a signal generation circuit 68 that generates the strobe control signal St and an image processing circuit 69 that generates image data while carrying out a known image processing that includes gamma correction or the like on an image signal IS input from the imaging element 47. The strobe control signal St generated by the signal generation circuit 68 is output to the light emission controller 66 and the latching circuit 63. The strobe control signal St is formed from a pulse signal with a predetermined period used in the strobe control that causes the light-emitting unit 43 to intermittently emit light. The strobe control signal St is a pulse signal that stipulates the light emission timing at which the light-emitting unit 43 is caused to emit light during imaging by the imaging device 20, that is, the imaging timing at which the medium P is irradiated with light. The above-described latching circuit 63 holds (latches) the rotation amount r that is the total value of the counter 62 with the pulse of the strobe control signal St as a trigger. Therefore, the latching circuit 63 holds the rotation amount r at the time when the imaging device 20 images the medium P.

The light emission controller 66 causes the light-emitting unit 43 to emit light at the generation period of the pulse of the strobe control signal St by outputting the strobe control signal St to the light-emitting unit 43 via the output port 61*b*. The imaging controller 65 outputs the imaging control signal to the imaging element 47 via the input/output port 61*c* and causes the imaging element 47 to perform imaging in the light emission period of the light-emitting unit 43. As a result, the imaging element 47 images the medium P when the light-emitting unit 43 emits light for an instant. The imaging signal IS obtained by imaging by the imaging element 47 is input to the imaging controller 65 via the input/output port 61*c*. In the imaging controller 65, the image processing circuit 69 generates the image data ID by carrying out the known image processing on the image signal IS, and the image data ID is output to the movement amount acquisition unit 67.

The movement amount acquisition unit 67 stores the previous image data ID in the storage unit, not shown, acquires the movement amount Δy of the medium P by performing a template matching process, described later, based on the previous and current image data ID each time the image data ID is input, and outputs the movement amount Δy to the controller 14 via the output port 61*e*.

Figure 10:
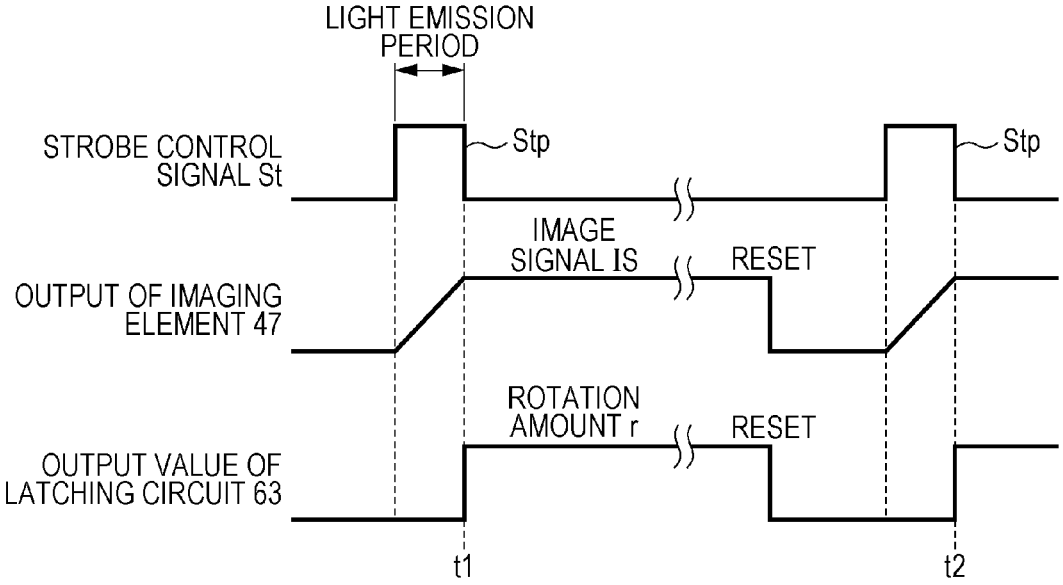
FIG. 10 is a signal waveform diagram illustrating a strobe control signal, output of an imaging element, and output of a latching circuit.

Next, the image processing by the imaging element 47 and the process by which the latching circuit 63 holds the rotation amount r performed synchronized based on the strobe control signal St will be described with reference to FIG. 10. As illustrated in FIG. 10, the strobe control signal St generated by the signal generation circuit 68 is a pulse signal that includes a plurality of pulses Stp with the same period as the imaging period of the medium P. The width of the pulse Stp stipulates the light emission period of the light-emitting unit 43 and is set to the light emission time necessary for imaging. As illustrated in FIG. 10, the imaging element 47 receives light as an image of the medium P when the light-emitting unit 43 emits light, and the potential rises by an electric charge being accumulated according to the amount of light received. When the pulse Stp falls, imaging ends and reading out of the image signal IS from the imaging element 47 is started. When the reading out of the image signal IS finishes, the imaging element 47 is reset slightly before the generation period of the next pulse Stp (light emission period).

As illustrated in FIG. 10, the latching circuit 63 holds the rotation amount r totaled by the counter 62 during the falling of the pulse Stp. The latching circuit 63 is reset slightly before the generation period of the next pulse Stp (light emission period), similarly to the imaging element 47. In this way, the falling of the pulses Stp of the strobe control signal St are synchronized so that the acquisition time (first time) of the rotation amount r totaled by the counter 62 and the imaging time (second time) of the medium P by the imaging device 20 match as a trigger. Therefore, the acquisition times T1, T2, . . . , Tn of the rotation amount r and the imaging times t1, t2, . . . , to of the medium P match. Thus, the rotation amount Δr and the movement amount Δy for the same times ti and ti+1 are acquired (refer to FIG. 7B).

Next, the movement amount acquisition process that acquires the movement amount Δy of the medium P will be described with reference to FIGS. 11A and 11B. The imaging device 20 continuously images the medium P for a fixed time period per unit time To during transport of the medium P. The movement amount acquisition unit 67 in the detection controller 21 acquires the movement distance of the medium P in the unit time To as the movement amount Δy based on two consecutive images in time series. The detection controller 21 performs the movement amount acquisition process for all of the images imaged during transport of the medium P.

Figure 11A:
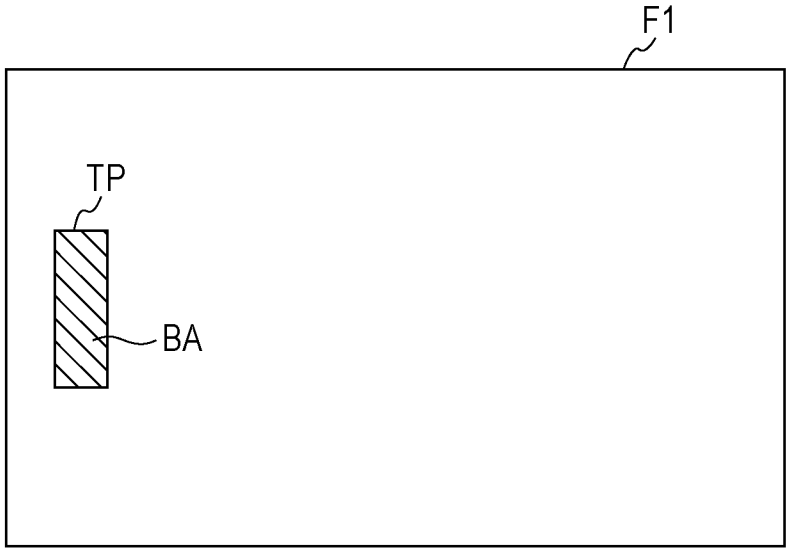
FIGS. 11A and 11B are schematic diagrams illustrating a process of acquiring a movement amount of a medium from a plurality of imaged images.
Figure 11B:
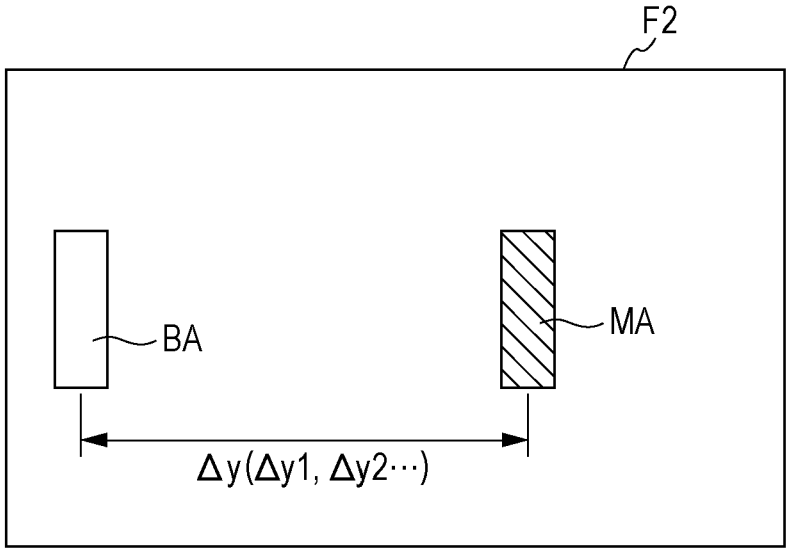

FIG. 11A illustrates the i-th (i is a natural number) image F1 from the imaging start and FIG. 11B illustrates the i+1-th image F2 from the imaging start. The texture of the rear surface of the medium P is imaged in each image F1 and F2.

In the movement amount acquisition process, first, the reference region BA set in advance in the image F1 illustrated in FIG. 11A is acquired as the template TP. In the reference region BA, a position as far as possible to the upstream side in the transport direction Y in the imaging area is selected. Next, a part that matches or is similar to the texture of the template TP is searched for in the image F2. For example, the movement amount acquisition unit 67 in the detection controller 21 sets a comparison region with the same shape and same size as the template TP in the image F2, compares the comparison region and the template TP, and performs a matching process that calculates the degree of similarity between the comparison region and the template TP. The movement amount acquisition unit 67 causes the comparison region to be shifted one pixel at a time in a predetermined direction for each time one matching process finishes. The matching process is executed each time a new comparison region is set. Thus, when the matching process is completed for all regions of the image F2, the movement amount acquisition unit 67 detects the comparison with the maximum degree of similarity as the matching region MA. The distance along the movement direction of the medium P between the reference region BA and the matching region MA is obtained. The distance obtained in this way is stored as the movement amount Δy.

In this way, the movement amount acquisition unit 67 executes the movement amount process based on the image F1 in which the medium P is imaged at the time t1 and the image F2 in which the medium P is imaged at the time t2, and acquires the movement amount Δy (refer to FIG. 11B) of the medium P between the times t1 and t2. The movement amount acquisition unit 67 performs the movement amount acquisition process for all of the images obtained during transport of the medium P and acquires the movement amounts Δy1 to Δyn (n is a natural number) for each unit time To.

Figure 12:
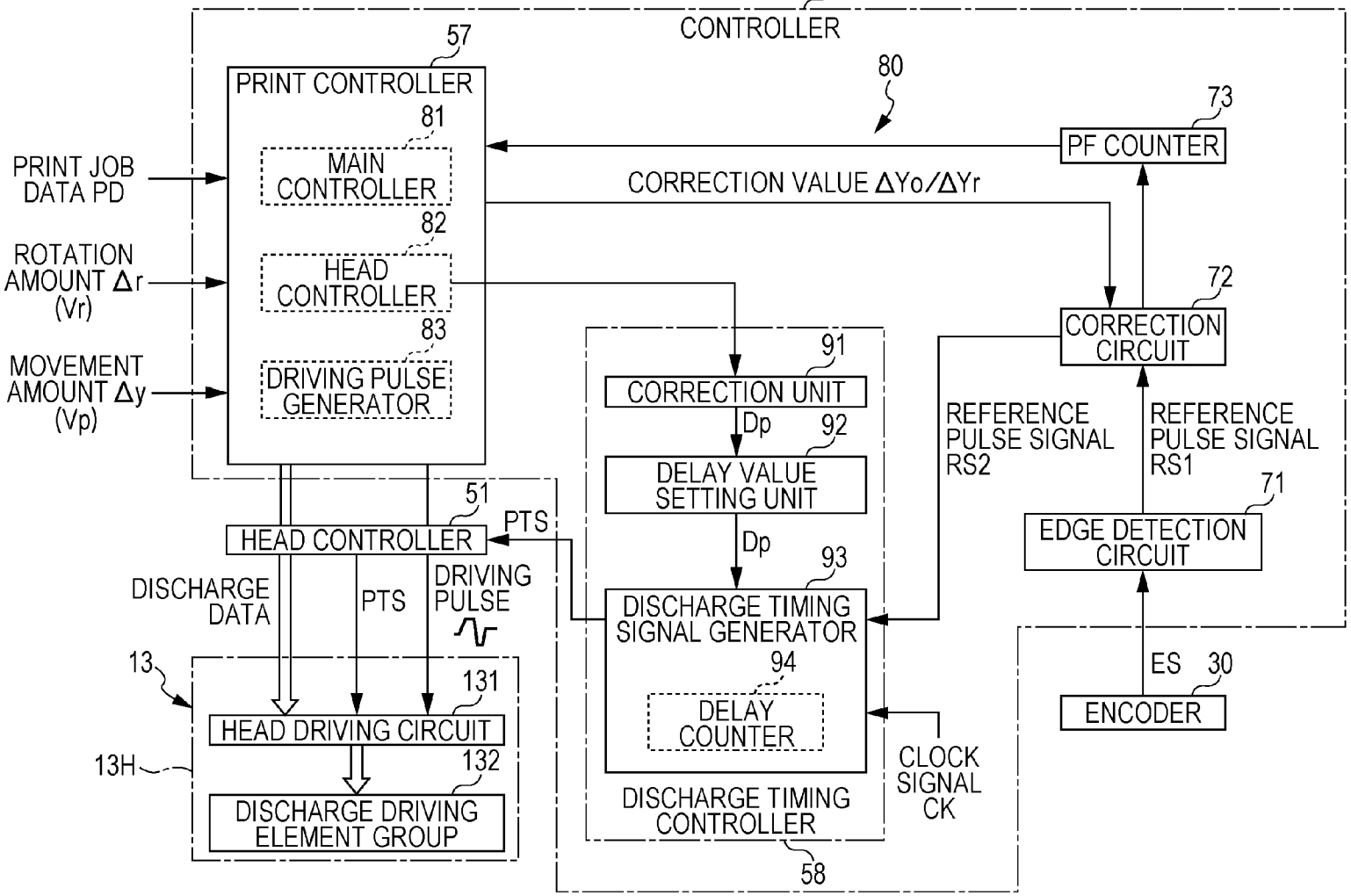
FIG. 12 is a block diagram illustrating the electrical configuration of a discharge timing control system.

Next, the electrical configuration of the discharge control system that controls the discharge timing of the print head 13H with the controller 14 will be described with reference to FIG. 12. As illustrated in FIG. 12, in addition to the above-described print controller 57 and discharge timing controller 58, an edge detection circuit 71, a correction circuit 72 a PF counter 73 or the like are provided in the controller 14. The print controller 57 includes a main controller 81, a head controller 82, and a driving pulse generator 83. The print controller 57 receives print instructions by print job data PD being input from a host device, and during transport of the medium P the rotation amount Δr and the movement amount Δy are input from the detection controller 21.

The main controller 81 administers various controls, such as discharge timing control of the print head 13H and driving control of the transport system motors 31 to 33.

The head controller 82 performs discharge control by which the print head 13H discharges ink droplets from a nozzle. The head controller 82 outputs discharge data generated by extracting print image data included in the print job data PD to the head driving circuit 13I. The head controller 82 outputs a reference value (delay reference value) that is a reference to the discharge timing controller 58 that corrects the discharge timing. The reference value is a reference delay value set so that the discharge timing becomes appropriate when the driving roller 18*a* reaches the target transport speed Vc (fixed speed). The reference value is set for each target transport speed Vc according to the print mode.

The driving pulse generator 83 generates a driving pulse that includes a plurality (for example, 2 or 3 types) of discharge wave form for each discharge period (one period) in which one dot is discharged from the nozzle, and outputs the driving pulse to the head driving circuit 13I via the head controller 51. The print head 13H is able to discharge ink droplets with a plurality of sizes, and, in the example, is able to discharge three types of small, medium, and large ink droplets as an example. The size of the ink droplets that the print head 13H is able to discharge may be one type or may be two or four or more types.

The controller 14 causes the medium P to be transported with a constant speed lower than during printing in which slippage does not occur between the driving roller 18*a* and the medium P with a setting operation of the printing apparatus 11 or a preparation operation before the printing start, and acquires the movement amount ΔYp of the medium P per rotation of the driving roller 18*a*. In a case where the diameter of the driving roller 18*a* is reduced smaller than the initial roller caused by friction or the like, the actual movement value ΔYp of the medium P per rotation changes to be smaller than the initial movement amount ΔYo of the initial roller diameter. The movement amount ΔYp of the medium P per rotation is acquired by obtaining the movement amount ΔYm=Δy1+Δy2+ . . . +Δym of the medium P, for example, when the driving roller 18*a* is rotated N times (N is a natural numbers) based on the acquired image, and the movement amount ΔYm is divided by N (ΔYp=ΔYm/N). The controller 14 outputs ΔYo/ΔYp to the correction circuit 72 as the correction value.

The edge detection circuit 71 inputs the encoder signal ES from the encoder 30, and causes a pulse to be generated each time the pulse edge is detected, and outputs a reference pulse signal RS1 with the same period as the encoder signal ES.

The correction circuit 72 generates the reference pulse signal RS2 in which the pulse period of the reference pulse signal RS1 is corrected based on the correction value ΔYo/ΔYp instructed from the print controller 57. The reference pulse signal RS2 is output to the PF counter 73 and the discharge timing controller 58 from the correction circuit 72.

The PF counter 73 acquires the necessary transport position y after performing control of the motors 31 to 33 based on the speed control data VD by being reset prior to the driving start of the transport system motors 31 to 33, and, after the driving start, for example, totaling the number of pulse edges of the reference pulse signal RS2 input from the correction circuit 72. The print controller 57 acquires the present transport position y from the PF counter 73, and acquires the target speed according to the transport position y with reference to the speed control data VD (FIG. 5). The controller 14 is provided with a counter, not shown, that acquires the pulse period Tprt by totaling the number of pulse edges of the clock signal CK input from one pulse of the reference pulse signal RS2 to the next pulse, and acquires the reciprocal of the pulse period Tprt totaled by the counter as the actual speed. The print controller 57 performs speed control on the transport motor 32 so that the actual speed approaches the target speed. The medium P is accelerated, held at speed, or decelerated following a speed profile illustrated in FIG. 5, and ink droplets are discharged from the print head 13H to the medium P transported at a constant target transport speed Vc.

The discharge timing controller 58 generates the discharge timing signal PTS by performing signal generation process using the reference pulse signal RS2 input from the correction circuit 72, the clock signal CK input from a clock circuit, not shown, or the like. The discharge timing controller 58 is provided with a correction unit 91, a delay value setting unit 92, and a discharge timing signal generator 93.

A multiplication process in which a reference timing signal PRS (refer to FIG. 13) with a pulse period in which the pulse period of the reference pulse signal RS2 is divided (multiplied) plural times and a delay process in which a discharge timing signal PTS is generated with the reference timing signal PRS delayed by the delay time are included in the signal generation process performed by the discharge timing controller 58. The discharge timing signal PTS generated by the discharge timing controller 58 is output to the print head 13H of the printing unit 13 via a head controller 51.

Here, when the roller diameter of the driving roller 18*a* is reduced by friction or the like, and the movement amount of the medium P per rotation of the driving roller 18*a* is shortened, as long as the discharge period Tj of the print head 13H is the same, the dot pitch in the transport direction Y of the print dots is shortened, and the print resolution in the transport direction Y becomes comparatively high. Therefore, the correction circuit 72 corrects the pulse period of the discharge timing signal PTS by generating the reference pulse signal RS2 in which the pulse period of the reference pulse signal RS1 is corrected to ΔYo/ΔYp times. In a case where the driving roller 18*a* rotates eccentrically, even if the rotation speed of the driving roller 18*a* is constant, because the peripheral speed at the nip point of the driving roller 18*a* periodically fluctuates caused by the eccentric rotation, the movement speed of the medium P fluctuates. The discharge timing controller 58 corrects the discharge timing according to this type of speed fluctuation.

The main controller 81 acquires the gap PG between the print head 13H and the medium P with reference to gap selection data, not shown, based on information of the print mode and the medium type (for example, sheet type) acquired from the print condition information included in the print job data PD. The main controller 81 further acquires the target transport speed Vc (constant speed) according to the designated print mode. The main controller 81 inputs the rotation amount Δr at the nip point in which the eccentric rotation of the driving roller 18*a* per unit time is taken into consideration and the movement amount Δy of the medium P per unit time from the detection controller 21. As described above, the rotation amount Δr per unit time corresponds to the medium estimated movement speed Vr in which the eccentric rotation of the driving roller 18*a* is taken into consideration and the movement amount Δy per unit time of the medium P corresponds to the actual medium movement speed Vp.

The head controller 82 outputs the each item of information of the gap PG, the target transport speed Vc, the medium estimated movement speed Vr and the medium movement speed Vp to the correction unit 91 in the discharge timing controller 58.

The correction unit 91 acquires each item of information of the gap PG, the target transport speed Vc, the peripheral speed V(θ), the medium estimated movement speed Vr (=Δr), and the medium movement speed Vp (=Δy) from the head controller 82. The correction unit 91 calculates the delay value Dp (number of PTS delay steps) with the following expression, using each item of information of the gap PG, the ink discharge speed Vm, the target transport speed Vc, the peripheral speed V(θ), the medium estimated movement speed Vr, and the medium movement speed Vp.

$$Dp=Do+(PG/Vm)\cdot(Vc-V(0)+Vr-Vp) \quad (1)$$

Here, Do is a reference delay value enabling ink droplets to be landed on the target position when the medium P is moving as the target transport speed Vc, the value of "0 (zero)" or higher is set (Do≥0). V(θ) is the peripheral speed at the nip point in which the eccentric rotation of the driving roller 18*a* is taken into consideration represented as the function with the rotation angle θ of the driving roller 18*a*. In other words, V(θ) is the equivalent to the estimated movement speed of the medium when not slipping of the medium according to the rotation angle θ of the driving roller 18*a* is assumed.

The controller 14 is provided with a counter for totaling the rotation angle, and acquires the rotation angle θ by resetting the counter each time the origin signal of the encoder 30 is input, and causing the counter to total the number of pulse edges of the input encoder signal ES after the reset. The controller 14 stores the correction data indicating the correspondence relationship between the rotation angle θ and the peripheral speed V(θ) in the memory 14*a* as an example of the storage unit. The controller 14 acquires the peripheral speed V(θ) according to the rotation angle θ with reference to the correction data based on the occasional rotation angle θ measured by the counter.

The first sampling period TS1 of the peripheral speed V(θ) is shorter than the second sampling period TS2 in which the medium estimated movement speed Vr and the medium movement speed Vp are acquired. In contrast to the second sampling period TS2 being set to a value enabling one sampling per predetermined rotation within a range of ⅕ to 2 rotations of the driving roller 18*a*, the first sampling period TS1 is set to a value enabling sampling a predetermined number of times within a range of 10 to 100 per one rotation of the driving roller 18*a*. It is possible for both sampling periods TS1 and TS2 to be set to an appropriate value according to the imaging speed of the imaging device 20, the roller diameter and the rotation speed of the driving roller 18*a*, or the like, as long as the condition of TS1<TS2 is satisfied. In a case of the imaging speed being a high speed in proportion to the rotation speed of the driving roller 18*a*, such as using an imaging device 20 capable of high speed imaging, the second sampling period TS2 may be set to the same or a lower value than the first sampling period TS1.

Thus, the delay value Dp increases and decreases according to fluctuations in the peripheral speed V(θ) at the nip point during eccentric rotation of the driving roller 18*a* when there is no slipping of the medium P, is corrected to a small value when the peripheral speed V(θ) fluctuates to the high speed side, and is corrected to a large value when fluctuating to the low speed side. In the embodiment, an example of the second acquisition unit is formed by the counter for totaling the rotation angle and functional parts that detect the peripheral speed (θ) in the controller 14. The first sampling period TS1 corresponds to an example of the first period, and the second sampling period TS2 corresponds to an example of the second sampling period.

(Vr−Vp) in the above-described expression (1) indicates the slippage amount per unit time of the medium P to the driving roller 18*a*. When this type of slipping occurs, since the actual medium movement speed Vp becomes slower than the medium estimated movement speed Vr indicated by the peripheral speed at the nip point of the driving roller 18*a*, the delay value Dp increases as the slip amount (=Vr−Vp) increases.

The correction unit 91 sets the delay value Dp acquired with the above expression (1) in the delay value setting unit 92. The delay value setting unit 92 has, for example, a register, not shown, built-in, and setting of the delay value Dp is performed by the correction unit 91 storing the delay value Dp in the register.

The discharge timing signal generator 93 inputs the reference pulse signal RS2 from the correction circuit 72 and the clock signal CK from the clock signal, not shown, and inputs the delay value Dp from the delay value setting unit 92. The discharge timing signal generator 93 generates the reference timing signal PRS (refer to FIG. 13) multiplied by the reference pulse signal RS2 and the correction total pulse CP (refer to FIG. 13) with a sufficiently shorter pulse than the reference timing signal PRS.

Figure 13:
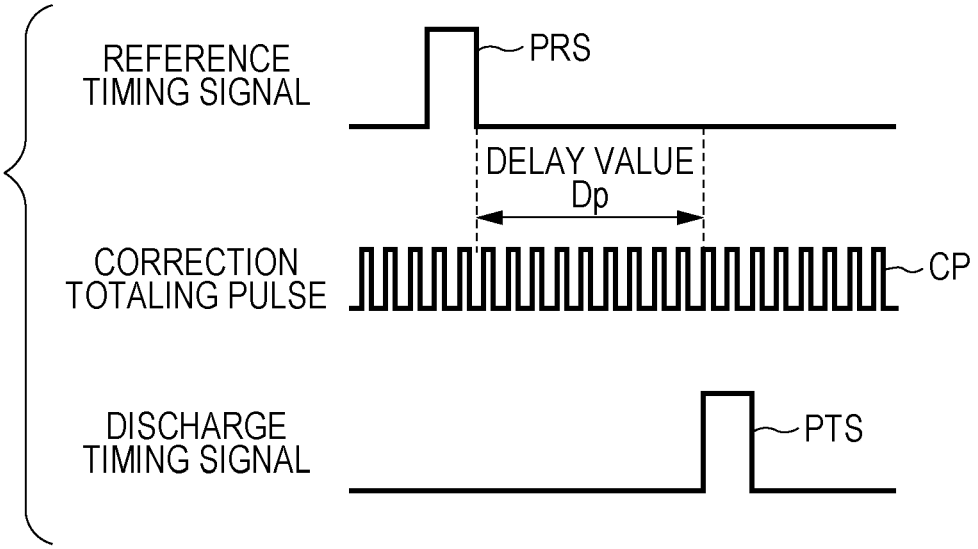
FIG. 13 is a signal waveform diagram illustrating a method of generating the discharge timing signal.

The discharge timing signal generator 93 is provided with a delay counter 94 for totaling the delay time based on the delay value Dp. The delay value Dp is set and the reference timing signal PRS and the correction total pulse CP are input to the delay counter 94. The delay counter 94 starts a countdown of the number of input pulses of the correction total pulse CP with the pulse of the reference timing signal PRS as a trigger as illustrated in FIG. 13, and when the total value of the delay counter 94 becomes "0 (zero)", the pulse is generated and the discharge timing signal PTS is output. That is, the discharge timing signal generator 93 generates the discharge timing signal PTS by outputting the pulse of the reference timing signal PRS at a timing delayed by a time according to the delay value Dp. The discharge timing signal PTS is output to the head driving circuit 131 in the printing unit 13 via the head controller 51.

The head driving circuit 131 inputs the discharge data and a plurality of types of driving pulse and applies a driving pulse with one or two types of discharge waveform selected according to the grayscale value of the pixel of the discharge data from the plurality of driving pulses to each discharge driving element that forms the discharge driving element group 132 at a timing based on the discharge timing signal PTS. By the driving pulse being applied to the discharge driving element, ink droplets with a size according to the discharge data are discharged from the nozzle 13*a*, for example, by the ink chamber expanding and contracting according to an electrorestrictive action or an electrostatic action.

The print controller 57 monitors the medium estimated movement speed Vr (=Δr) and the medium movement speed Vp (=Δy), and, in a case where there is a mismatch between both speeds Vr and Vp that exceeds a threshold, the print controller 57 determines the type of defect in the transport system from the content of the mismatch, and causes the content of the defect and measures to resolve the defect on a display unit 54 as an example of an output unit. An example of determining the type of defect in the transport system from the content of the mismatch in both speeds Vr and Vp will be shown below.

For example, even though the driving roller 18*a* rotates, any of an abnormality in medium size, missing of the medium, or the medium running out is determined in a case where the medium P is in a stopped state (Vr>0 and Vp=0). Even though the driving roller 18*a* is in a stopped state, it is determined that an abnormal force is acting on the medium P, such as a user pulling the medium P, in a case where the medium P is moving (Vr=0 and Vp>0). Even though the driving roller 18*a* is in a constant speed state, it is determined that the medium P is floating caused by a paper jam or the medium P hitting the print head 13H in a case where the movement amount of the medium P is extremely small (Vr=Vc and Vp<<Vr). In this way, when a defect in the transport system is detected based on the comparison results of both speeds Vr and Vp, the print controller 57 causes the occurrence of the defect and resolution measured therefor to be displayed together on the display unit 54 via the display driving circuit 53. The method of notifying of the defect is not limited to display by the display unit 54, and may be printing on the medium by the printing unit 13, or output of an audio or alarm by a speaker or the like.

Next, the actions of the printing apparatus 11 will be described. In the printing apparatus 11, when the print controller 57 in the controller 14 receives the print job data PD, the print controller 57 acquires the target transport speed Vc and the ink discharge speed Vm determined from the print mode designated at this time, and the gap PG determined from the print mode and the sheet type, and sends this information to the correction unit 91.

The controller 14 performs speed control on transport system motors 31 to 33 based on the speed control data VD (refer to FIG. 5) corresponding to the print mode. The medium P is transported a constant target transport speed Vc by the rotation of the driving roller 18*a*. The encoder signal ES is input from the encoder 30 that detects the rotation of the driving roller 18*a* to the controller 14.

In the printing apparatus 11, the medium P is transported with a constant speed lower than during printing with a pre-set operation or a preparation operation before the printing start, and the movement amount ΔYp of the medium P per rotation of the driving roller 18*a* is acquired. The controller 14 stores the initial movement amount ΔYo that is the movement amount of the medium P per rotation during the initial roller diameter in which the driving roller 18*a* starts to be used by the printing apparatus 11 in the memory 14*a*, and outputs the ratio ΔYo/ΔYp of the initial movement amount ΔYo and the current movement amount ΔYp actually measured to the correction circuit 72 (refer to FIG. 12) as the correction value. The correction circuit 72 generates the reference pulse signal RS2 in which the pulse period from the reference pulse signal RS1 input from the edge detection circuit 71 is corrected to ΔYo/ΔYp times and outputs the reference pulse signal RS2 to the PF counter 73 and the discharge timing signal generator 93.

The PF counter 73 acquires the transport position y with the driving start time of the motors 31 to 33 as an origin by totaling the number of pulse edges of the reference pulse signal RS2. The controller 14 obtains the reciprocal of the value for which the speed detecting unit, not shown, counts the pulse period of the reference pulse signal RS2 to acquire the actual speed, and performs speed control in which the actual speed approaches the obtained target speed with reference to the speed control data VD based on the transport position y. In this way, the medium P is transported at the fixed target transport speed Vc. In the embodiment, the process in which the medium P is transported by rotation of the driving roller 18*a* that forms the transport device 12 corresponds to an example of the transport step.

During transport of the medium P, the light emission controller 66 of the second detecting unit 56 in the detection controller 21 illustrated in FIG. 9 causes the light-emitting unit 43 to intermittently emit light based on the strobe control signal St generated by the imaging controller 65. At this time, the imaging controller 65 instructs the imaging element 47 to perform imaging with the imaging control signal synchronized with the light emission instructions according to the strobe control signal St. Thus, when the medium P reaches the imaging area of the imaging device 20, imaging of the medium P during transport is started by the imaging device 20. The image signal IS in which the medium P is imaged by the imaging element 47 of the imaging device 20 is input to the second detecting unit 56 in the detection controller 21 via an input/output port 61*c*. The imaging controller 65 in the second detecting unit 56 outputs the image data ID generated by the image processing circuit 69 therein carrying out the known image processing on the image signal IS to the movement amount acquisition unit 67. In this way, the image data ID imaged by the imaging element 47 for each unit time To of substantially the same period as the pulse period of the strobe control signal St is sequentially input to the movement amount acquisition unit 67. In the embodiment, the process in which the medium P is imaged with the imaging device 20 causing the light-emitting unit 43 to intermittently emit light corresponds to an example of the imaging step.

The movement amount acquisition unit 67 in the second detecting unit 56 performs the template matching process and sequentially acquires the movement amount Δy (=medium movement speed Vp) for each unit time To of the medium P using the previous image F1 and the current image F2, as illustrated in FIGS. 11A and 11B each time the image data ID of the medium P is acquired via the imaging controller 65. In the embodiment, the process in which the second detecting unit 56 acquires the movement amount Δy (=Vp) based on the plurality of images F1 and F2 corresponds to an example of the acquisition step.

The counter 62 in the first detecting unit 55 totals the number of pulse edges of the encoder signal ES and acquires the occasional rotation amount r of the driving roller 18*a*. The latching circuit 63 holds the rotation amount r input from the counter 62 during input of the pulse Stp of the strobe control signal St, and more specifically during falling of the pulse Stp. The rotation amount acquisition unit 64 acquires the rotation amount Δr (=medium estimated movement speed Vr) per unit time in which the eccentric rotation of the driving roller 18*a* is taken into consideration with reference to the correction data of the storage unit based on the rotation amount δr per unit time acquired from the difference between the previous rotation amount r1 stored in the storage unit and the current rotation amount r2 input from the latching circuit 63. In the embodiment, the process in which the first detecting unit 55 acquires the rotation amount Δr (=Vr) of the driving roller 18*a* as an example of the rotation information corresponds to an example of the detection step.

At this time, as illustrated in FIG. 10, imaging of the medium P by the imaging element 47 is performed at the same time synchronized with the holding of the rotation amount r by the latching circuit 63 during falling of the pulse Stp of the strobe control signal St. Therefore, as illustrated in FIG. 7B, the times T1 and T2, and T2 and T3 during acquisition of the movement amount Δy (Δy1, Δy2) based on the image of the imaged medium P and the times t1 and t2, and t2 and t3 during detection of the rotation amount Δr (Δr1, Δr2) based on the encoder signal ES are synchronized. In this way, the rotation amount Δr (medium estimated movement speed Vr) per unit time detected by the first detecting unit 55 and the movement amount Δy (medium movement speed Vp) per unit time of the medium P detected by the second detecting unit 56 are output to the controller 14 in a state in which synchronization is attained.

As illustrated in FIGS. 6B and 6C, the movement speed of the medium P fluctuates according to the rotation angle θ of the driving roller 18*a*, for example, when the driving roller 18*a* rotates eccentrically at a constant speed. In the controller 14, the rotation angle θ is acquired as a total value by the counter reset each time the origin signal is input totaling the pulse edges of the encoder signal ES. The controller 14 acquires the peripheral speed V(θ) in which the eccentric rotation of the driving roller 18*a* is taken into consideration according to the rotation angle θ with reference to the correction data stored in the memory 14*a* based on the rotation angle θ. Acquisition of the peripheral speed V(θ) is performed in the first sampling period TS1 (<TS2) that is shorter than the second sampling period TS2 in which the rotation amount Δr and the movement amount Δy are acquired. The controller 14 outputs the peripheral speed V(θ), the rotation amount Δr (medium estimated movement speed Vr) input from the detection controller 21, and the movement amount Δy (medium movement speed Vp) to the correction unit 91. Detection of the peripheral speed V(θ) may be performed by the detection controller 21 instead of the controller 14.

Meanwhile, the discharge timing signal generator 93 generates the reference timing signal PRS with the same period as the discharge period and the correction total pulse CP (for either, refer to FIG. 13) with a sufficiently shorter pulse period than the reference timing signal PRS by multiplying the input reference pulse signal RS2 using the clock signal CK. The reference timing signal PRS and the correction total pulse CP are input to the delay counter 94.

The correction unit 91 sets the delay value Dp calculated with the above expression (1) in the delay value setting unit 92 using the gap PG input from the print controller 57, ink discharge speed Vm, the target transport speed Vc, the peripheral speed V(θ), the medium estimated movement speed Vr, and the medium movement speed Vp. The delay value Dp is calculated each time the peripheral speed V(θ) is calculated, and is updated for each first sampling period TS1. The delay value Dp is calculated each time the medium estimated movement speed Vr (=Δr) and the medium movement speed Vp (=Δy) are acquired and updated for each second sampling period TS2. The delay value Dp is set in the delay value setting unit 92 each time the value is updated.

Thus, the delay value Dp is updated based on the peripheral speed V(θ) at the first sampling period TS1 indicated by the interval in the black colored point groups in FIG. 7B. The delay value Dp is updated in the second sampling period TS2 based on the medium estimated movement speed Vr (=Δr) and the medium movement speed Vp (=Δy) acquired for each unit time To. At this time, because synchronization between the detection time of the rotation amount r and the imaging time of the medium P is attained, the delay value Dp calculated based on both speeds Vr and Vp becomes suitable.

In the discharge timing signal generator 93, when the total value reaches "0 (zero)" according to the countdown of the delay value Dp started by the delay counter 94 at the point when the pulse of the reference timing signal PRS is input, a pulse is generated and the discharge timing signal PTS is generated. The discharge timing signal PTS is output to the head driving circuit 131 via the head controller 51. The head driving circuit 131 causes ink droplets to be discharged from the nozzle 13*a* of the print head 13H by performing drive control on the discharge driving element group 132 based on the discharge data, the driving pulse, and the discharge timing signal PTS.

When the roller diameter of the driving roller 18*a* is reduced due to friction or the like, the peripheral speed thereof is relatively slowed in proportion to the rotation speed of the driving roller 18*a*. However, in the example, the pulse period of the reference pulse signal RS2 is adjusted to ΔYo/ΔYp times the pulse period of the encoder signal ES by the correction circuit 72. Therefore, even if the roller diameter becomes smaller than the initial value, it is possible for the pulse period of the discharge timing signal PTS to be matched to a suitable discharge timing according to the movement speed of the medium P at this time.

As illustrated in FIGS. 6B and 6C, and 7B, even if the movement speed of the medium P periodically fluctuates due to the eccentric rotation of the driving roller 18*a*, the value of the peripheral speed V(θ) used in the calculation of the delay value Dp fluctuates according to the rotation angle θ of the driving roller 18*a*. Therefore, the delay value Dp fluctuates according to the value of the peripheral speed V(θ). As a result, as illustrated in FIG. 6B, the delay value Dp is corrected to be low when the nip point of the driving roller 18*a* fluctuates to the high speed side, and, as illustrated in FIG. 6C, the delay value Dp is corrected to be larger when the nip point of the driving roller 18*a* fluctuates to the low speed side. Thus, as illustrated by the black colored point group in FIG. 7B, because the delay value Dp fluctuates to a suitable value according to the fluctuation of the peripheral speed V(θ) caused by the eccentric rotation of the driving roller 18*a*, it is possible to generate a suitable discharge timing signal PTS according to the speed fluctuations of the medium P caused by the eccentric rotation of the driving roller 18*a*. Accordingly, even if the driving roller 18*a* rotates eccentrically, printing dots with a substantially constant dot pitch in the transport direction Y are formed on the medium P.

As illustrated in FIG. 7B, the acquisition time of the rotation amount r and the imaging time of the medium P are the same when the driving roller 18*a* rotates eccentrically. Therefore, as long as there is no slipping of the medium P, the rotation amount Δr (=Vr) and the movement amount Δy (=Vp) become the same value and if there is slipping of the medium P, a difference arises according to the slippage amount between the rotation amount Δr (=Vr) and the movement amount Δy (=Vp). Thus, in a case where slipping arises with respect to the driving roller 18*a* of the medium P, the delay value Dp is corrected according to the slippage amount (Vr−Vp) per unit time. As a result, even if the medium P slips with respect to the driving roller 18*a*, printing dots with a substantially constant dot pitch in the transport direction Y are formed on the medium P. In this way, in the printing apparatus 11 of the embodiment, even if there are changes in the roller diameter of the driving roller 18*a*, eccentric rotation of the driving roller 18*a*, and slipping with respect to the driving roller 18*a* of the medium P, it is possible to print images, text, or the like on the medium P with printing dots with a substantially constant dot pitch in the transport direction Y.

According to the first embodiment described in detail above, the following effects can be obtained.

(1) The acquisition of the rotation amount r by the first detecting unit 55 (example of a detecting unit) and the imaging of the medium P by the imaging device 20 are synchronized based on the strobe control signal St that stipulates the radiation timing at which the medium P is intermittently irradiated with light by the light-emitting unit 43. For example, even if the driving roller 18*a* is eccentric, it is possible for the acquired rotation amount Δr (medium estimated movement speed Vr) per unit time and the movement amount Δy (medium movement speed Vp) per unit time to be given the same rotation angle θ of the driving roller 18*a*. Thus, it is possible to avoid a shift amount, which should not be present, being detected or a shift amount, which should be present, not being detected based on the difference between the medium estimated movement speed Vr and the medium movement speed Vp. Therefore, it is possible to perform control to a suitable discharge timing based on both speed Vr and Vp and it is possible to perform print control with high precision.

(2) The imaging controller 65 provides the strobe control signal St by which the medium P is intermittently irradiated with light by the light-emitting unit 43 to the first detecting unit 55. The first detecting unit 55 acquires the rotation amount r at a timing based on the strobe control signal St, and the imaging device 20 images an image of the medium P when irradiated with light from the light-emitting unit 43 based on the strobe control signal St. As a result, the detection time of the rotation amount r by the first detecting unit 55 and the imaging time of the medium P by the imaging device 20 are synchronized and become substantially the same. Thus, it is possible to make the rotation angle θ of the driving roller 18*a* the same when the rotation amount Δr (medium estimated movement speed Vr) per unit time based on the difference δr between the previous and current rotation amounts r1 and r2 and the movement amount Δy (medium movement speed Vp) per unit time of the medium P based on the previous and current images F1 and F2 are acquired.

(3) The controller 14 controls the discharge timing of the print head 13H based on the medium estimated movement speed Vr (Δr) and the medium movement speed Vp (=Δy). That is, the discharge timing of the print head 13H is controlled by the controller 14 based on the rotation amount Δr and the movement amount Δy acquired in substantially the same time segment. Thus, the discharge timing of the print head 13H can be more suitably controlled.

(4) The first detecting unit 55 is provided with the counter 62 that detects the rotation amount of the driving roller 18*a* and the latching circuit 63. The medium estimated movement speed Vr (=Δr) is acquired with reference to the correction data indicating the correspondence relationship between the rotation angle θ of the driving roller 18*a* and the movement amount of the medium P based on the rotation amount δr detected by the counter 62 and the latching circuit 63. The controller 14 corrects the discharge timing of the print head 13H based on the medium estimated movement speed Vr and the medium movement speed Vp. Thus, even if the driving roller 18*a* rotates eccentrically, it is possible to control the printing dots at a constant pitch in the transport direction Y of the medium P, by detecting the slippage amount of the medium P from the difference between the medium estimated movement speed Vr and the medium movement speed Vp and controlling the print head 13H to a suitable print timing according to the slippage amount.

(5) The controller 14 acquires the peripheral speed V(θ) according to the occasional rotation angle θ measured by the counter and corrects the pulse period of the discharge timing signal PTS based on the peripheral speed V(θ). The first sampling period TS1 of the peripheral speed V(θ) is shorter than the second sampling period TS2 in which the medium estimated movement speed Vr and the medium movement speed Vp are acquired. For example, for the reason that the imaging device 20 holds the required time necessary for imaging of the medium P or the like, the second sampling period TS2 in which the print timing is corrected based on the medium estimated movement speed Vr and the medium movement speed Vp is not relatively shortened in proportion to the rotation period of the driving roller 18*a*. In this case, since first sampling period TS1 at which the print timing is corrected based on the medium estimated movement speed Vr is shorter than the second sampling period TS2 and is sufficiently shorter than the rotation period of the driving roller 18*a*, it is possible to perform correction to a suitable print timing according to fluctuation in the peripheral speed during eccentric rotation of the driving roller 18*a*.

(6) The controller 14, when the difference between the medium estimated movement speed Vr (=Δr) and the medium movement speed Vp (Δy) exceeds a threshold, displays that a defect in the transport system of the medium P and resolution measures therefor on the display unit 54. Thus, it is possible for a user to be informed that a defect in the transport system occurs and the resolution measured therefor from the display content of the display unit 54.

(7) The detection controller 21 ends the irradiation of the medium P with light by the light-emitting unit 43 started during rising of the pulse Stp of the strobe control signal St during falling of the pulse Stp. The medium P is imaged by the imaging device 20 when light is radiated from the light-emitting unit 43. The latching circuit 63 holds the rotation amount r detected by the counter 62 during falling of the pulse Stp of the strobe control signal St. Thus, it is possible for the time at which the rotation amount Δr is detected and the time at which the medium P is imaged to be more precisely matched. For example, when the driving roller 18*a* rotates eccentrically, when the rotation angle θ of the driving roller 18*a* when the medium estimated movement speed Vr (=Δr) and the medium movement speed Vp (Δy) are acquired is shifted, a shift, which should not be present, arises or a shift, which should be present, does not arise between the both speeds Vr and Vp. However, according to the embodiment, when the driving roller 18*a* rotates eccentrically, since the rotation angle θ of the driving roller 18*a* when the medium estimated movement speed Vr and the medium movement speed Vp are acquired is substantially the same, it is possible for ink droplets to be discharged at a suitable discharge timing based on both speeds Vr and Vp.

(8) The controller 14 causes the medium P to be transported with a constant speed lower than during printing with a setting operation of the printing apparatus 11 or a preparation operation before the printing start, and acquires the movement amount ΔYp of the medium P per rotation of the driving roller 18*a*. The ratio ΔYo/ΔYp between the initial movement amount ΔYo and the current movement amount ΔYp of the medium P per rotation when the driving roller 18*a* has the initial roller diameter is output to the correction circuit 72 as the correction value. The correction circuit 72 corrects the pulse period of the reference pulse signal RS2 that stipulates the pulse period of the discharge timing signal PTS to ΔYo/ΔYp times the pulse period of the encoder signal ES. Thus, even if the roller diameter of the driving roller 18*a* changes from the initial value or a constant slipping of the medium P occurs, it is possible to generate the reference timing signal PRS generated by multiplying the reference pulse signal RS2 at a suitable pulse period matched to the movement speed of the medium P at this time. Thus, even if the movement amount of the medium P per rotation of the driving roller 18*a* changes from the initial value, it is possible to form printing dots at a substantially constant dot pitch in the transport direction Y of the medium P, and it is possible to provide a printed matter with a high print quality.

Second Embodiment

Next, the second embodiment applied to a printing apparatus 11 formed from a serial printer will be described with reference to FIG. 14. Description of the configurations in common with the first embodiment will not be provided and, in particular, only the points of difference with the first embodiment will be described.

Figure 14:
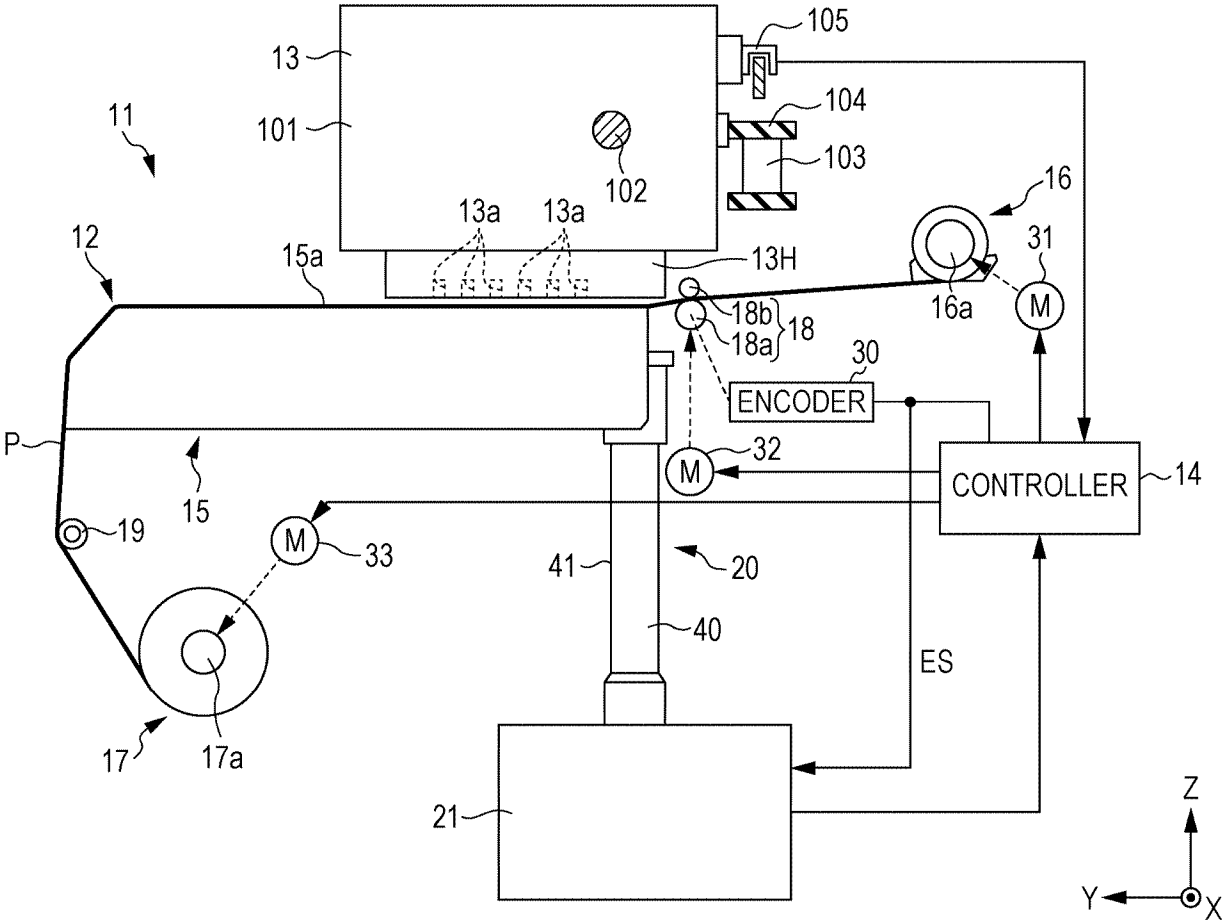
FIG. 14 is a schematic side diagram illustrating a serial-type printing apparatus in a second embodiment.

As illustrated in FIG. 14, in the printing apparatus 11 formed from a serial printer, the printing unit 13 is provided with a carriage 101 able to reciprocate along the scanning direction X (same as the width direction) that intersects (in particular, orthogonal to) the transport direction Y of the medium P and a print head 13H fixed to the side (in FIG. 14, lower side) that faces the support surface 15*a* of the carriage 101. The carriage 101 is provided to be able to reciprocate in the scanning direction X along the guide shaft 102 and is fixed to one end of an endless timing belt 104 wound on a pair of pulleys 103 (only one shown in FIG. 14) positioned in the vicinity of both ends of the movement path of the carriage 101. A linear encoder 105 capable of outputting the encoder signal that includes a number of pulses proportional to the movement amount in the scanning direction X of the carriage 101 is provided on the rear surface side (in FIG. 14, right side) of the carriage 101, in the printing apparatus 11. The controller 14 ascertains the position (carriage position) in the scanning direction X of the carriage 101 based on the encoder signal input from the linear encoder 105 and generates the discharge timing signal PTS based on the encoder signal.

In the case of a serial-type printing apparatus 11, when the medium P is fed to the printing start position, printing is performed on the medium P by substantially alternately performing a printing operation that prints one line (one pass) by discharging ink droplets from the nozzle 13*a* of the print head 13H during movement while the carriage 101 is moved in the scanning direction X and a transport operation that transports the medium P to the next printing position in the transport direction Y. The controller 14 starts the movement of the medium P when the target transport amount ΔY1 by which the medium P is transported to the next printing position is acquired. The controller 14 performs speed control on the transport motor 32 according to a speed profile based on the speed control data VD illustrated in FIG. 5, and performs the transport operation once.

During transport of the medium P, the movement amount Δy of the medium P per unit time is sequentially acquired by the imaging device 20 and the detection controller 21 based on the two consecutive images F1 and F2 (refer to FIGS. 11A and 11B) of the medium P imaged by the imaging device 20 per unit time. The controller 14 sums all of the movement amounts Δy1 to Δyn and acquires the current actual movement amount ΔYact of the medium P. For the serial printer, stopping between the transport operation and the next transport operation is also included in the "process of being transported" in which imaging of the medium P is performed by the imaging device 20 as an example of the imaging unit. Thus, in the embodiment, because imaging per unit time of the medium P is also performed by the imaging device 20 while stopping between the transport operation and the next transport operation, if the medium P moves even slightly caused by anything during stopping between transport operations, the movement amount Δy of the medium P is acquired. Naturally, during stopping between transport operations, under the assumption that the medium P does not move, is not included in the "process of being transported" and imaging of the medium P may be stopped. In the embodiment, the current actual movement amount ΔYact of the medium P corresponds to an example of the movement information.

The first detecting unit 55 in the detection controller 21 sequentially detects the rotation amount Δr per unit time of the driving roller 18*a* based on the encoder signal ES from the encoder 30. The rotation amount Δr, similarly to the first embodiment, is the movement length in the rotation direction per unit time at the nip point in which the eccentric rotation of the driving roller 18*a* is taken into consideration. The controller 14 sums all of the rotation amounts Δn to Δrn and acquires the current movement amount ΔYenc upon transport control of the medium P. In the embodiment, the current movement amount ΔYenc upon transport control corresponds to an example of the rotation information.

The controller 14 corrects the target transport amount ΔY1 so that the movement amount ΔYenc upon transport control is matched to the actual movement amount ΔYact, to acquire the corrected target transport amount ΔY2, in a case where the correspondence relationship between the movement amount ΔYenc upon transport control and the actual movement amount ΔYact of the medium P is shifted until the transport of the medium P is finished. In the transport process of the medium P, when the forward determination start position is too much further to the upstream side in the transport direction Y than the deceleration start position yb (refer to FIG. 5), the controller 14 sequentially acquires the shift amount from the current movement amounts ΔYenc and ΔYact and sequentially sets the corrected target transport amount ΔY2 according to the shift amount. The controller 14 controls the transport system motors 31 to 33, and causes the driving of the motors 31 to 33 to stop so that the medium P is stopped at the point in time at which the movement amount ΔYenc reaches the corrected target transport amount ΔY2. As a result of the control, the medium P stops at a position at which the actual movement amount ΔYact matches the initial target transport amount ΔY1. Even if the medium P provisionally moves during stopping between the transport operations, the rotation amount Δr acquired during the stopping is added to the next movement amount ΔYenc and the movement amount Δy acquired during the stopping is added to the next actual movement amount ΔYact. Thus, during provisional stopping between transport operations, even if the medium P moves slightly by any cause such as vibration from a vibration source such as the carriage 101 during movement at this time, in the next transport operation, it is possible for the medium P to be stopped at a position at which the actual movement amount ΔYact of the medium P matches the initial target transport amount ΔY1.

For example, as illustrated in FIGS. 6B and 6C, and FIG. 7B, when the driving roller 18*a* rotates eccentrically, in the detection controller 21, synchronization between the time at which the first detecting unit 55 detects the rotation amount r and the time at which the imaging device 20 images the medium P is achieved based on the strobe control signal St. Therefore, as illustrated in FIG. 7B, the times T1 to T3 at which the rotation amount r detected by the first detecting unit 55 is acquired and the times t1 to t3 at which the medium P is imaged match. Thus, the rotation amount Δr and the movement amount Δy when the driving roller 18*a* has the same rotation angle θ are acquired.

For example, as illustrated in FIG. 7A, the rotation amount Δr and the movement amount Δy when the driving roller 18*a* has a different rotation angle θ are acquired. In this case, a shift amount that does not exist in practice is detected between the movement amount ΔYenc upon transport control and the actual movement amount ΔYact of the medium P or a shift amount that exists in practice is not detected caused by a shift in the rotation amount Δr and the movement amount Δy caused by the eccentric rotation of the driving roller 18*a*.

However, according to the embodiment, as illustrated in FIG. 7B, because the rotation amount Δr and the movement amount Δy when the driving roller 18*a* has the same rotation angle θ are acquired, even if the driving roller 18*a* rotates eccentrically, the movement amount ΔYenc upon transport control and the actual movement amount ΔYact of the medium P are acquired together as correct values. Thus, when both movement amounts ΔYenc and ΔYact are compared, only a shift amount that exists in practice is detected, and a shift amount that does not exist in practice is not detected.

In a case where the medium P is transported while slipping slightly with respect to the driving roller 18*a*, a shift amount arises between the movement amount ΔYenc upon transport control that is a sum value of the rotation amounts Δn to Δrn and the actual movement amount ΔYact of the medium that is a sum value of the actual movement amounts Δy1 to Δyn of the medium P. Therefore, corrected target transport amount ΔY2 is set so that the medium P is stopped at a position at which the actual movement amount ΔYp of the medium P reaches the corrected target transport amount ΔY1. The controller 14 performs driving control of the motor 31 to 33 and causes the medium P to stop at a position at which the movement amount ΔYenc reaches the corrected target transport amount ΔY2. In this way, even if the medium P slips with respect to the driving roller 18*a*, it is possible for the medium P to be stopped at the next printing position with good positional precision. As a result, it is possible to print on the medium P with a high print quality even if the medium P slips with respect to the driving roller 18*a*.

It is possible to avoid a lowering of the print quality occurring by a slippage, which should not be present, occurring caused by the time at which the rotation amount is acquired and the time at which the medium P is imaged being shifted and correction according to the shift amount instead causing the medium P to be stopped at an unsuitable printing position. In a case where a shift arises between the movement amount ΔYenc that is a sum value of the rotation amount Δr and the movement amount ΔYact that is the sum value of the movement amount Δy, rather than corresponding by correcting the target transport amount ΔY1 at the current transport step, a configuration may be used that corrects the next target transport amount by the shift amount.

According to the second embodiment a described in detail above, it is possible to obtain the effects shown below, in addition to similarly obtaining the effects (1) to (8) in the first embodiment.

(9) In a case where there is a shift between the movement amount ΔYenc upon transport control acquired by summing the rotation amounts Δr1 to Δrn input per unit time and the actual movement amount ΔYact of the medium P acquired by summing the movement amounts Δy1 to Δyn input per unit time during transport of the medium P, the target transport amount ΔY1 and the corrected target transport amount ΔY2 that is corrected based on the shift amount are set. The controller 14 performs driving control on the transport system motors 31 to 33 so that the medium P is stopped at the stop position when the movement amount ΔYenc upon transport control reaches the corrected target transport amount ΔY2. Thus, it is possible to transport the medium P to the next printing position with good precision and it is possible to print on the medium P with a high print quality.

Third Embodiment

Next, the third embodiment will be described with reference to FIG. 15 and the like. The embodiment is an example in which the sampling period is given is performed a predetermined number of times in a range from 10 to 100 per rotation of the driving roller 18*a*, in the printing apparatus 11 formed from a line printer. The configuration of the printing apparatus 11 is the same as in the first embodiment.

Figure 15:
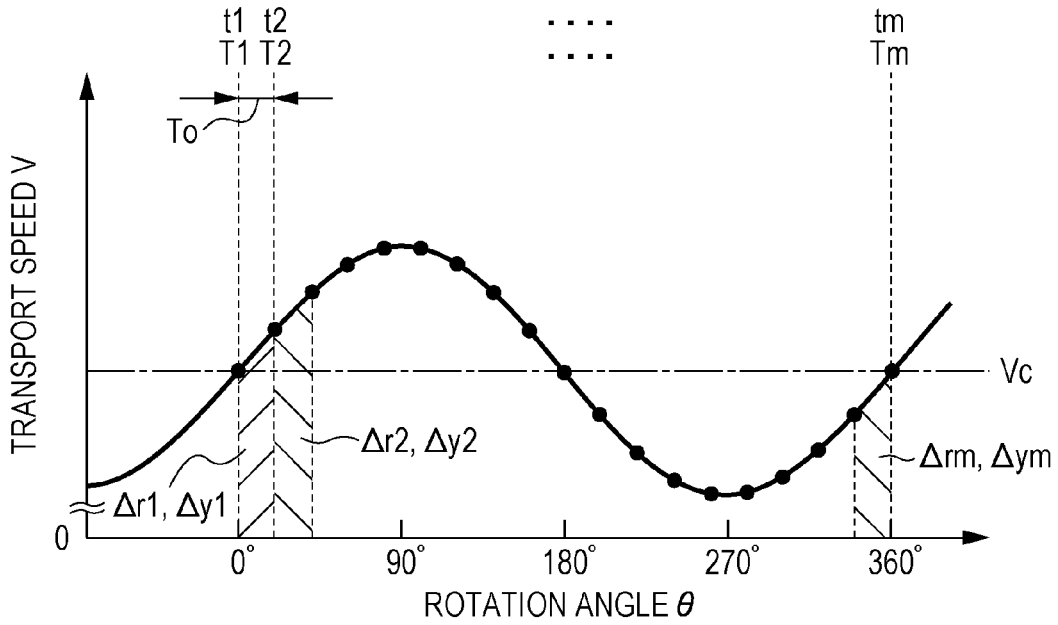
FIG. 15 is a graph illustrating an example in which the detection time of the rotation amount of the driving roller and the imaging time of the medium in a third embodiment are synchronized.

As illustrated in FIG. 15, because the driving roller 18*a* rotates eccentrically, the peripheral speed at the nip point of the driving roller 18*a* and the movement speed of the medium P fluctuate according to the rotation angle θ of the driving roller 18*a*. In the graph illustrated in FIG. 15, the number of samplings per rotation of the driving roller 18*a* becomes a predetermined number within a range of 10 to 100 as illustrated by the plurality of black point groups on the speed curve, and FIG. 15 illustrates and example where the number of samplings per rotation of the driving roller 18*a* is 18. The unit time To is set to a value able to ensure the above number of samplings while the driving roller 18*a* rotates one at a speed during printing. The unit time To is sufficiently shorter than the unit time To in the first embodiment.

The first detecting unit 55 illustrated in FIG. 9 detects the rotation amount δr per unit time in which the eccentric rotation of the driving roller 18*a* is not taken into consideration, that is, the rotation speed Vθ of the driving roller 18*a*. Specifically, the counter 62 acquires the rotation amount r by totaling the number of pulse edges of the encoder signal ES. The latching circuit 63 holds the rotation amount r input that is a total value of the counter 62 during falling of the pulse Stp of the input strobe control signal St. The rotation amount acquisition unit 64 computes the difference between the previous rotation amount r1 stored in storage unit and the current rotation amount r2 held by the latching circuit 63, and acquires the rotation amount δr per unit time, that is, the rotation speed of the driving roller 18*a*. The first detecting unit 55 is further provided with a counter for totaling the rotation angle, not shown, used in order to acquire the rotation angle θ of the driving roller 18*a*. The counter is reset each time the origin signal is input from the encoder 30, and acquires the rotation angle θ from the origin of the driving roller 18*a* by totaling the number of pulse edges of the encoder signal ES. In this way, the first detecting unit 55 detects the rotation angle θ of the driving roller 18*a* and the rotation speed Vθ per unit time. In the embodiment, the rotation speed Vθ (=δ) and the rotation angle θ correspond to an example of the rotation information.

The second detecting unit 56, similarly to the first embodiment, acquires the movement amount Δy per unit time of the medium P (that is, the medium movement speed Vp) per unit time. In the embodiment, the medium movement speed Vp indicated by the movement amount Δy per unit time corresponds to an example of the movement information.

The correction unit 91 calculates delay value Dp using the gap PG, ink discharge speed Vm, the target transport speed Vc, and the medium movement speed Vp acquired from the print controller 57 using the following expression.

$$Dp=Do+(PG/Vm)\cdot(Vc-Vp) \quad (2)$$

Here, the delay value Dp is a value suitable to the medium movement speed Vp at the time the medium P is imaged, and is not a value strictly suitable to the discharge time at which the ink droplets are discharged at the discharge timing based on the calculated delay value Dp. Therefore, a delay value Dp suitable to discharge at the time Tk at which the medium P is imaged and the discharge time Tk+1 when discharge is performed at a timing based on the delay value Dp, for example, the discharge time Tk+1 at which the next or subsequent discharge is performed is estimated.

At this time, the medium movement speed Vp at the time Tk+1 necessary for calculation of the delay value Dp is estimated. The rotation angle θk+1 at the time Tk+1 is obtained from the rotation angle θk at the time Tk, the time between the times Tk to Tk+1 and the rotation speed Vθ of the driving roller 18*a*. The medium movement speed Vp at the discharge time Tk+1 is estimated from the obtained rotation angle θk+1. The estimation is obtained, for example, by adding the amount of the movement speed fluctuation of the medium P when the rotation angle proceeds from θk to θk+1 to the medium movement speed Vp at the time Tk.

For example, history data indicating the correspondence relationship between the rotation angle θ of the newest single rotation or more past and the medium movement speed Vp is stored in the storage unit, and the medium movement speeds Vpk and Vpk+1 corresponding to when the rotation angle proceeds from θk to θk+1 are acquired from the history data. The movement speed fluctuation amount is obtained from the difference Vpk+1−Vpk of both, the speed fluctuation amount "Vpk+1−Vpk" is added to the medium movement speed Vpk, and the medium movement speed Vp at the discharge time Tk+1 is acquired. The delay value Dp at the time Tk+1 is calculated by the expression (2) using the medium movement speed Vp at the time Tk+1. In the embodiment, the discharge time Tk+1 corresponds to an example of the printing time.

According to the third embodiment, the following effects can be obtained.

(10) The medium movement speed Vp at the discharge time k+1 at which discharge is actually performed is estimated from the medium movement speed Vp acquired at the time Tk at which the medium P is imaged and the rotation angle θ and the rotation speed Vθ of the driving roller 18*a* at this time, and the delay value Dp that stipulates the discharge timing at the discharge time Tk+1 using the estimated medium movement speed Vp is calculated. Thus, in the discharge time Tk+1, it is possible for ink droplets to be discharged from the print head 13H at a suitable discharge timing based on the suitable delay time Dp matched to the movement speed of the medium P at this time. Thus, compared to a discharge timing based on the delay value Dp calculated using the medium movement speed Vp at the point in time when the medium P is imaged, it is possible control the print head 13H at a more suitable discharge timing and to perform printing with a much higher print quality.

It is possible for the embodiment to be modified in the forms outlined below.

The control content of at least one of the transport device 12 and the print head 13H may be corrected. For example, the control content of the transport device 12 may be corrected without correcting the discharge timing of the print head 13H, or the discharge timing of the print head 13H may be corrected without correcting the control content of the transport device 12. For example, speed control may be performed on the motors 31 to 33 with the value in which the ratio Vθ/Vp of the rotation speed Vθ (example of rotation information) acquired by the first detecting unit 55 based on the encoder signal ES and the medium movement speed Vp (example of movement information) is multiplied by the target transport speed Vc as the target transport speed after correction. For example, speed control may be performed with the value in which the target speed according to the transport position y obtained with reference to the speed control data VD made a multiple of V0/Vp as the target speed after correction.

The calculation expression for the delay value Dp may be the expression Dp=Do+(PG/Vm)·(Vc−V(θ))·Vr/Vp, or may be the expression Dp=Do+(PG/Vm)·(Vc/V(θ))·(Vr−Vp), instead of the expression (1). The other calculation expressions may be used, or the discharge timing may be corrected with another method other than the correction methods using the delay value Dp in which the reference timing signal PRS is delayed.

In the first and second embodiments, the peripheral speed V(θ) of the driving roller 18*a* in the above expression (1) may be left out and the discharge timing may be corrected without using the correction data for the eccentric rotation indicating the correspondence relationship between the rotation information and the movement information.

In each embodiment, the controller 14 may correct both the target transport amount and the target transport speed with the transport device 12 based on the rotation information and the movement information.

The control signal that determines the radiation timing is not limited to the strobe control signal St. For example, a shutter that determines the radiation timing may be provided in the imaging device and a shutter control signal that controls the opening and closing of the shutter maybe used. The shutter control signal is a pulse signal periodically having a pulse that opens the shutter. The imaging device irradiates the medium P with light from the light-emitting unit in a period in which the shutter is open and images an image of the medium P when the light is radiated. In this configuration, it is possible to synchronize the detection of the rotation information by the detecting unit and the imaging of the medium by the imaging unit based on the shutter control signal.

The transport device 12 as an example of a transport unit is not limited to a roller transport method, and may use a belt transport method in which an endless transport belt that transports the medium is provided. In the case of a belt transport method, a detecting unit may be configured detecting the rotation of one roller of a plurality of roller on which the endless transport belt is wrapped with an encoder.

In a case where the transport device 12 uses a belt transport method, an encoder may be used that directly detects the driving amount of the transport belt with a linear scale, such as an electromagnetic scale, formed in a region (for example, a side edge portion) other than the mounting region of the medium on the transport belt wrapped on the rotating rollers. In this way, the detecting unit may indirectly detect the rotation of the rotating roller. The detecting unit may further include an encoder that detects the rotation of the motor that is the power source for the transport device.

The detecting unit is not limited to a configuration that includes the encoder and may be an imaging unit such as an imaging element (image sensor). For example, the rotation information may be acquired by detecting the outer peripheral surface of the rotating roller with the imaging unit. In the belt transport method transport device, the rotation information of the rotating roller may be acquired based on the image in which the peripheral surface of the transport belt or the rotating roller is imaged with the imaging unit.

In the printing apparatus 11 of the first embodiment, the delay value Dp that stipulates the discharge timing during the discharge time may be estimated matched to the next or subsequent discharge time as in the third embodiment.

The light radiated by the light-emitting unit when the medium is imaged is not limited to visible light, and may be infrared rays or ultraviolet rays.

In a case of transport device 12 of a roller transport method provided with a discharge roller pair, the rotating roller may be the driving roller of the discharge roller pair, instead of the driving roller of the transport roller pair. The rotating roller may also be the driven roller.

As in the printing apparatus disclosed in JP-A-2010-284883, when the correction data indicating the correspondence relationship between the rotation angle due to the eccentric rotation of the rotating roller and the movement amount of the medium is created, the data may be applied in a configuration that acquires the rotation information (for example, rotation angle) of the rotating roller and the movement information (for example, movement amount) of the medium. That is, when the correction data is created, for example, the acquisition time of the rotation information and the imaging time of the medium are synchronized based on the radiation timing at which the medium is irradiated with light by the imaging unit. It is possible for the control signal that stipulates the radiation timing to use a strobe control signal, a shutter control signal or the like.

Detection of a defect in the transport system based on the rotation information and the movement information may be performed and only the error control that outputs the occurrence thereof to an output unit may be performed without performing the correction of the discharge timing and the correction of the transport amount. According to this configuration, since the detection time of the rotation information and the imaging time of the image are synchronized to the same time, even if the rotating roller rotates eccentrically, it is possible to reduce the frequency at which erroneous notification of errors is performed.

In each embodiment, a region before printing on the printing surface (for example, the surface) of the medium P may be imaged by the imaging device 20. The non-printing surface (for example, rear surface) of a printed region of the medium P may be imaged. The printing region on the printing surface may be imaged as long as the movement information is obtained. Furthermore, a position further to the downstream side in the transport direction than the printing region of the medium P may be imaged.

A plurality of imaging devices may be provided. For example, an imaging device that is able to image the medium during feeding until the printing start position is reached may be added. At this time, for example, a configuration may be used that acquires the movement information (for example, movement amount $\Delta Yp$) based on the image in which the medium is imaged during feeding, and provided the correction value $\Delta Yo/\Delta Yp$ to the correction circuit 72. According to the configuration, there is no need to measure the movement amount $\Delta Yp$ in advance.

In each embodiment, the detection controller 21 that obtains the detection value by controlling the imaging device 20 may be incorporated in the controller 14 instead of a configuration provided separately to the controller 14.

In each embodiment, the first detecting unit 55 may detect the rotation amount $\Delta r$ at a timing during rising of the pulses of the strobe control signal St.

In order to achieve synchronization of the detection time of the rotation information by the detecting unit and the imaging time of the medium, the detection period of the rotation information may be adjusted by the control signal used in the light emission control of the light-emitting unit or the opening and closing control of the shutter being delayed via a timing adjustment circuit, such as a delay circuit.

In the first embodiment, the second sampling period in which the rotation information and the movement information are acquired may be longer than the first sampling period in which the peripheral speed $V(\theta)$ is acquired, and may be a predetermined value within, for example, a range of ⅕ to 2 rotations of the driving roller 18*a*. The first sampling period may be the second sampling period or more. In this case, it is preferable to set the second sampling period is set to a value enabling 10 to 360 samplings per rotation of the rotating roller.

Each functional unit constructed in the print controller 57 in the controller 14 may be realized with software by a computer that executed a program, may be realized with hardware by an electronic circuit such as a field-programmable gate array (FPGA) or an application specific IC (ASIC), or may be realized through cooperation of software and hardware.

The medium is not limited to a continuous paper and may be a cut-form paper (cut paper). The medium is not limited to a paper, and may be a film or sheet made of resin, a composite film (laminate film) of resin and metal, a textile, a non-woven fabric, a metal foil, a metal film, a ceramic sheet or the like. Furthermore, the medium is not limited to a flat shape such as a paper or sheet, and may be a solid having a predetermined shape, such as a cylinder, a rectangular parallelepiped, a cone or a pyramid.

The printing apparatus is not limited to an ink jet-type, and may be a dot impact-type or may be an electrophotographic-type, such as a laser method or an LED method. In the case of a dot impact-type or an electrophotographic-type, as long as the transport amount or the transport speed of the medium are corrected based on the rotation information and the movement information, it is possible to print at a suitable position on the medium.

The printing apparatus is not limited to a line printer or a serial printer, and may be a lateral-type printer or a page printer. The printing apparatus may be a composite device.

This application claims priority under 35 U.S.C. §119 to Japanese Patent Application No. 2015-095439, filed May 8, 2015. The entire disclosure of Japanese Patent Application No. 2015-095439 is hereby incorporated herein by reference.

What is claimed is:

1. A printing apparatus, comprising:

a transport unit that transports a medium by the rotation of a rotating roller;

a print head that prints on the medium;

an imaging unit that images the medium when transported;

a detecting unit that detects rotation information of the transport unit;

an acquisition unit that acquires movement information of the medium based on a plurality of images with different imaging times at which the medium is imaged; and a controller that performs control of at least one of the transport unit and the print head based on the rotation information and the movement information, wherein the imaging unit includes a light-emitting unit that irradiates the medium with light, and the controller causes a timing of the acquisition of the rotation information by the detecting unit and a timing of the imaging of the medium by the imaging unit to be synchronized based on the radiation timing at which the medium is intermittently irradiated with light by the light-emitting unit.

2. The printing apparatus according to claim 1, wherein the controller causes the detecting unit to detect the rotation information based on a control signal that provides instructions by which the medium is intermittently irradiated with light by the light-emitting unit to the imaging unit.

3. The printing apparatus according to claim 1, wherein the controller corrects the transport amount or transport speed of the transport unit to be controlled based on the rotation information and the movement information.

4. The printing apparatus according to claim 1, wherein the controller controls the print timing of the print head based on the rotation information and movement information.

5. The printing apparatus according to claim 4, wherein correction data indicating the correspondence relationship between a rotation angle of the rotating roller and the movement amount of the medium is stored in a storage unit, the detecting unit detects the rotation amount and the rotation angle of the rotating roller, and acquires, as rotation information, estimated movement information that is movement information estimated for the medium based on the rotation amount and the rotation angle with reference to the correction data, and the controller corrects the print timing of the print head based on the estimated movement information and the movement information.

6. The printing apparatus according to claim 4, further comprising:

a second acquisition unit that acquires an estimated movement speed of the medium according to the rotation angle of the rotating roller, wherein the controller corrects the print timing based on estimated movement speed, the rotation information, and the movement information, and a first period at which the print timing is corrected based on the estimated movement speed is shorter than a second period at which the print timing is corrected based on the rotation information and the movement information.

7. The printing apparatus according to claim 4, wherein the rotation information includes the rotation angle and the rotation speed of the rotating roller, the movement information is the movement speed of the medium, and the controller estimates the rotation information and the movement information during the printing time performed after the time at which the medium is imaged, based on the rotation angle and the rotation speed, and corrects the print timing during the printing time based on the estimated rotation information and the movement information.

8. The printing apparatus according to claim 1, wherein the rotation information is an estimated movement speed of the medium estimated based on the rotation speed of the rotating roller, the movement information is the movement speed of the medium, and the controller, when a difference between the estimated movement speed and the movement speed exceeds a threshold, outputs that a defect in the transport system occurs to an output unit.

9. The printing apparatus according to claim 1, further comprising:

an imaging controller that controls the imaging unit, wherein the detecting unit includes an encoder that either directly or indirectly detects the rotation of the rotating roller, a rotation amount detecting unit that detects a rotation amount of the rotating roller based on a detection signal of the encoder, and a latching unit that holds a detection value of the rotation amount detecting unit and acquires the rotation information based on the rotation amount held by the latching unit, and the imaging controller controls the imaging unit based on a control signal formed from a pulse signal and provides the control signal to the latching unit, finishes irradiation of the medium with light by the light-emitting unit started during rising of the pulse of the control signal during falling of the pulse, and causes the latching unit to hold a detection value of the rotation amount detecting unit during falling of the pulse of the control signal.

10. A printing method, comprising:

transporting a medium through rotation of a rotating roller of a transport unit;

imaging the medium with an imaging unit when irradiated with light by a light-emitting unit that intermittently emits light when the medium is transported;

detecting rotation information of the rotating roller;

acquiring movement information of the medium based on a plurality of images with different imaging times at which the medium is imaged; and controlling at least one of a print head that prints on the medium and the transport unit based on the rotation information and the movement information, wherein, in the controlling, detection of a timing of the rotation information and a timing of imaging of the medium are synchronized based on the radiation timing at which the medium is intermittently irradiated with light by the light-emitting unit.

11. A printing apparatus, comprising:

a transport unit that transports a medium by the rotation of a rotating roller;

a print head that prints on the medium;

an imaging unit that images the medium when transported;

a detecting unit that detects rotation information of the transport unit;

an acquisition unit that acquires movement information of the medium based on a plurality of images with different imaging times at which the medium is imaged;

an imaging controller that controls the imaging unit; and a controller that performs control of at least one of the transport unit and the print head based on the rotation information and the movement information, wherein the imaging unit includes a light-emitting unit that irradiates the medium with light, and the controller causes the acquisition of the rotation information by the detecting unit and the imaging of the medium by the imaging unit to be synchronized based on the radiation timing at which the medium is intermittently irradiated with light by the light-emitting unit, wherein the detecting unit includes an encoder that either directly or indirectly detects the rotation of the rotating roller, a rotation amount detecting unit that detects a rotation amount of the rotating roller based on a detection signal of the encoder, and a latching unit that holds a detection value of the rotation amount detecting unit and acquires the rotation information based on the rotation amount held by the latching unit, and the imaging controller controls the imaging unit based on a control signal formed from a pulse signal and provides the control signal to the latching unit, finishes irradiation of the medium with light by the light-emitting unit started during rising of the pulse of the control signal during falling of the pulse, and causes the latching unit to hold a detection value of the rotation amount detecting unit during falling of the pulse of the control signal.

* * * * *